US012440725B2

(12) United States Patent
Aoki et al.

(10) Patent No.: US 12,440,725 B2
(45) Date of Patent: Oct. 14, 2025

(54) PEDAL SUPPORT STRUCTURE AND PEDAL SUPPORT SYSTEM

(71) Applicant: TOYOTA JIDOSHA KABUSHIKI KAISHA, Toyota (JP)

(72) Inventors: Eisuke Aoki, Toyota (JP); Tomio Ikeda, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 305 days.

(21) Appl. No.: 18/126,686

(22) Filed: Mar. 27, 2023

(65) Prior Publication Data

US 2023/0347205 A1 Nov. 2, 2023

(30) Foreign Application Priority Data

Apr. 28, 2022 (JP) ..... 2022-074583

(51) Int. Cl.
*A63B 22/06* (2006.01)
*A63B 21/02* (2006.01)
*A63B 22/00* (2006.01)

(52) U.S. Cl.
CPC ..... *A63B 22/0605* (2013.01); *A63B 22/0015* (2013.01); *A63B 21/025* (2013.01);
(Continued)

(58) Field of Classification Search
CPC ..... A63B 22/0664; A63B 22/0605; A63B 22/0015; A63B 22/0694;
(Continued)

(56) References Cited

U.S. PATENT DOCUMENTS 5,683,330 A 11/1997 Kobayashi
10,569,122 B2 * 2/2020 Johnson ..... A61H 1/0274
(Continued)

FOREIGN PATENT DOCUMENTS

CN 2268636 Y 11/1997
CN 101369643 A 2/2009
(Continued)

OTHER PUBLICATIONS

Trammel of Archimedes, "https://www.reddit.com/r/lego/comments/owzszc/satisfying_machine_thingy/" (Year: 2021).*
(Continued)

*Primary Examiner* — Megan Anderson
(74) *Attorney, Agent, or Firm* — Oliff PLC

(57) ABSTRACT

A left leg unit includes a vertical piece; a horizontal piece; a vertical guide groove; a horizontal guide groove; an outer coupling bar to which the vertical piece and the horizontal piece are rotatably coupled, thereby coupling the vertical piece and the horizontal piece to each other; and a pedal that is rotatably coupled to the outer coupling bar. The vertical guide groove and the horizontal guide groove are extended in such a way that they intersect with each other. A rotation axis of the pedal is disposed away from a rotation axis of the vertical piece and a rotation axis of the horizontal piece and is disposed away from a midpoint of a line that connects the rotation axis of the vertical piece and the rotation axis of the horizontal piece, whereby the rotation axis of the pedal moves along an elliptical trajectory.

7 Claims, 24 Drawing Sheets

(52) U.S. Cl.
CPC ..... *A63B 2022/0611* (2013.01); *A63B 2022/0617* (2013.01); *A63B 22/0664* (2013.01); *A63B 2022/0688* (2013.01); *A63B 2208/0233* (2013.01)

(58) Field of Classification Search
CPC .... A63B 2022/0617; A63B 2022/0688; A63B 2208/0233; A63B 21/023; A63B 21/025
See application file for complete search history.

(56) References Cited

U.S. PATENT DOCUMENTS

| | | | | |
|---|---|---|---|---|
| 2002/0028732 | A1 | 3/2002 | Kobayashi et al. | |
| 2008/0051258 | A1 | 2/2008 | Schmehl et al. | |
| 2008/0217881 | A1 | 9/2008 | Gobillard | |
| 2023/0078793 | A1* | 3/2023 | Mason | G06N 20/00 700/9 |

FOREIGN PATENT DOCUMENTS

| | | | | |
|---|---|---|---|---|
| JP | 2685131 | B2 | 12/1997 | |
| JP | H10-035182 | A | 2/1998 | |
| JP | 3465044 | B2 | 11/2003 | |
| JP | 2007-99063 | A | 4/2007 | |
| JP | 4112574 | B2 | 7/2008 | |
| KR | 20020045090 | A | 6/2002 | |
| TW | 200909020 | A | 3/2009 | |
| WO | WO-2006078168 | A1 * | 7/2006 | A63B 22/001 |

OTHER PUBLICATIONS

"Elliptic compasses"; https://kousakukiroku.blogspot.com/2010/10/TremmelOfArchimedes.html.
English Translation of Sep. 24, 2024 Notice of Reasons for Refusal in Japanese Patent Application No. 2022-074583.

* cited by examiner

FRONT-BACK DIRECTION

VERTICAL DIRECTION

FRONT-BACK DIRECTION

VERTICAL DIRECTION

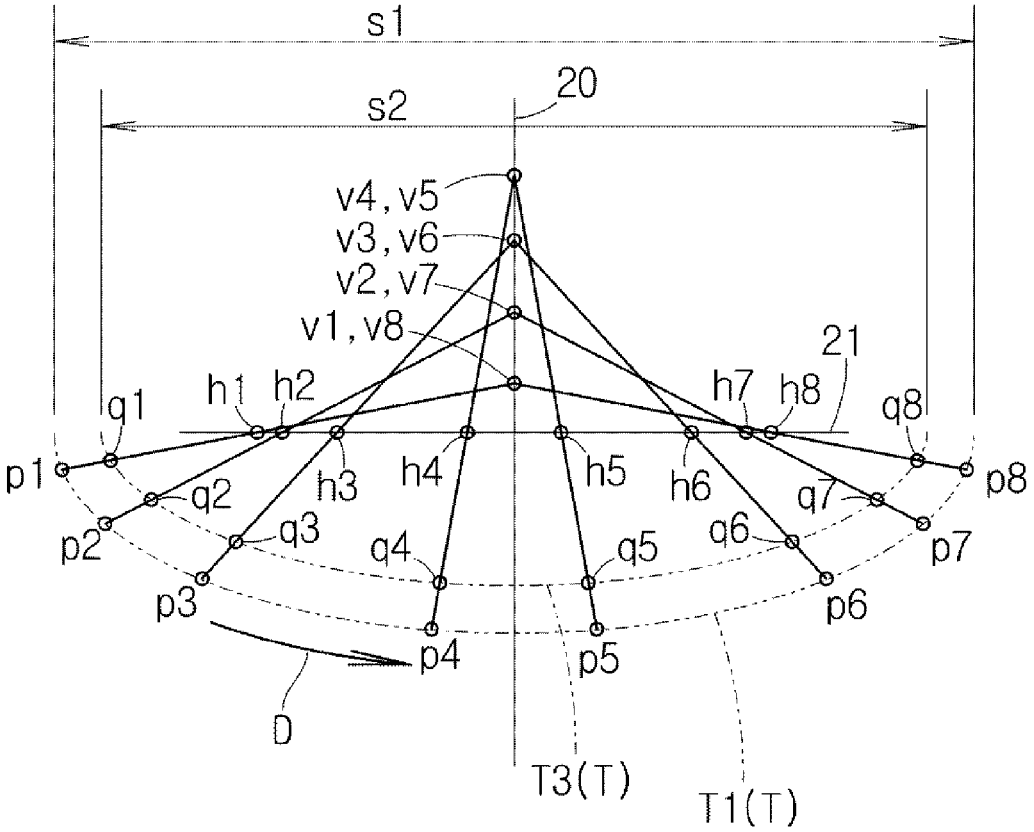
Fig. 11
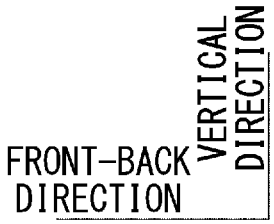

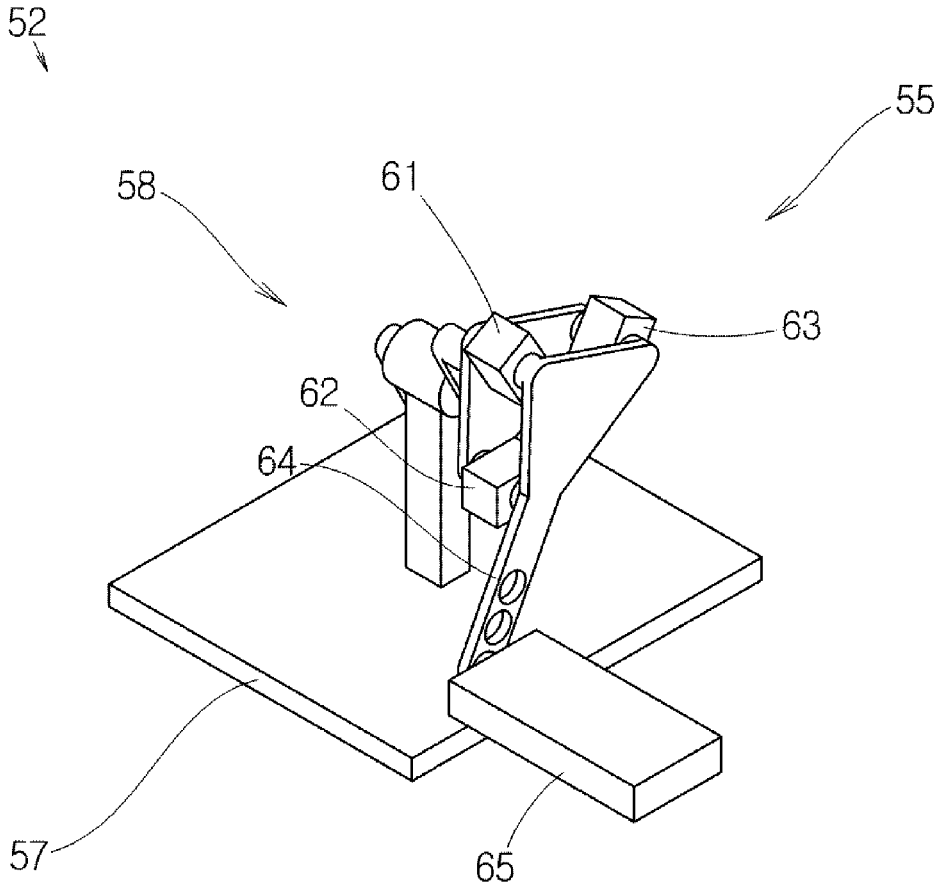
Fig. 15
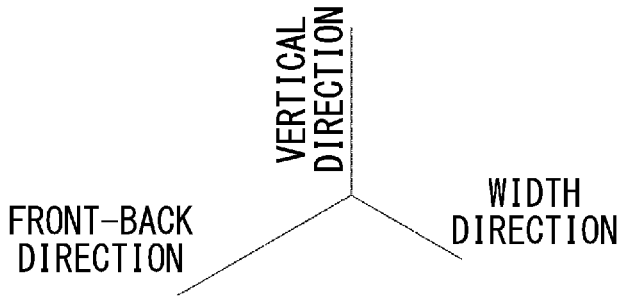

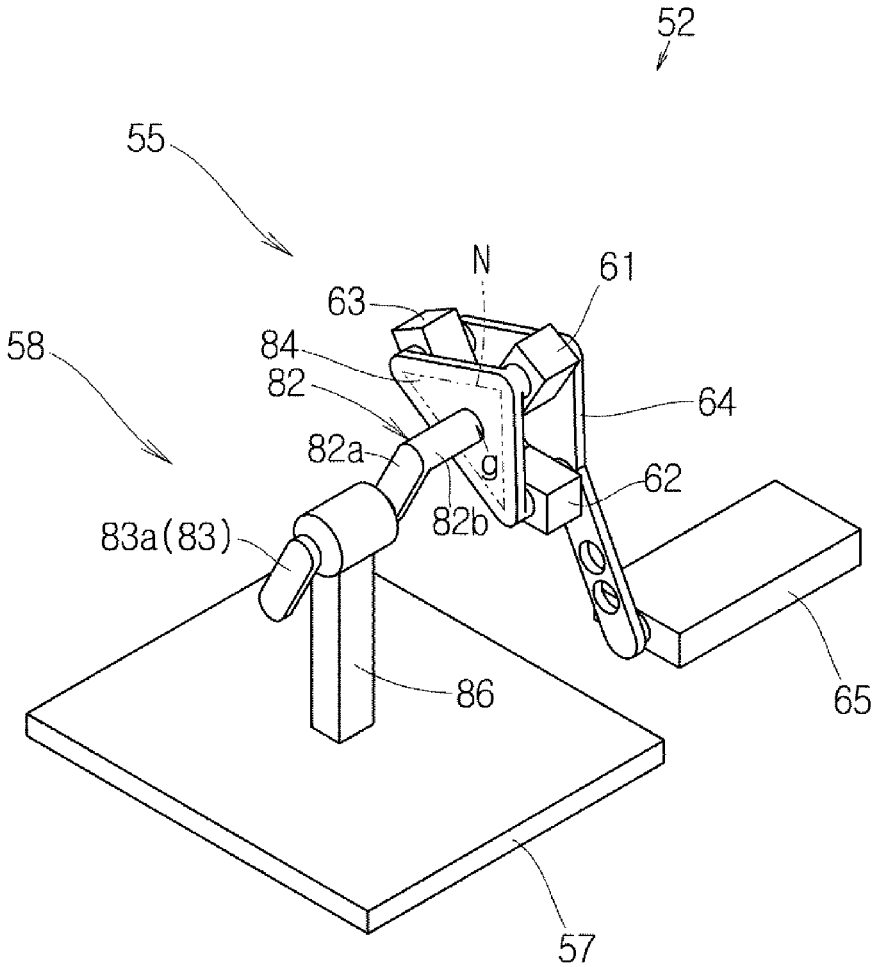
Fig. 16
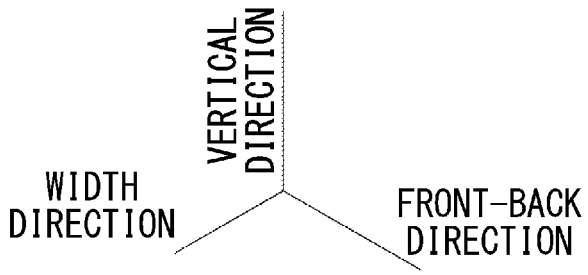

FRONT-BACK DIRECTION

VERTICAL DIRECTION

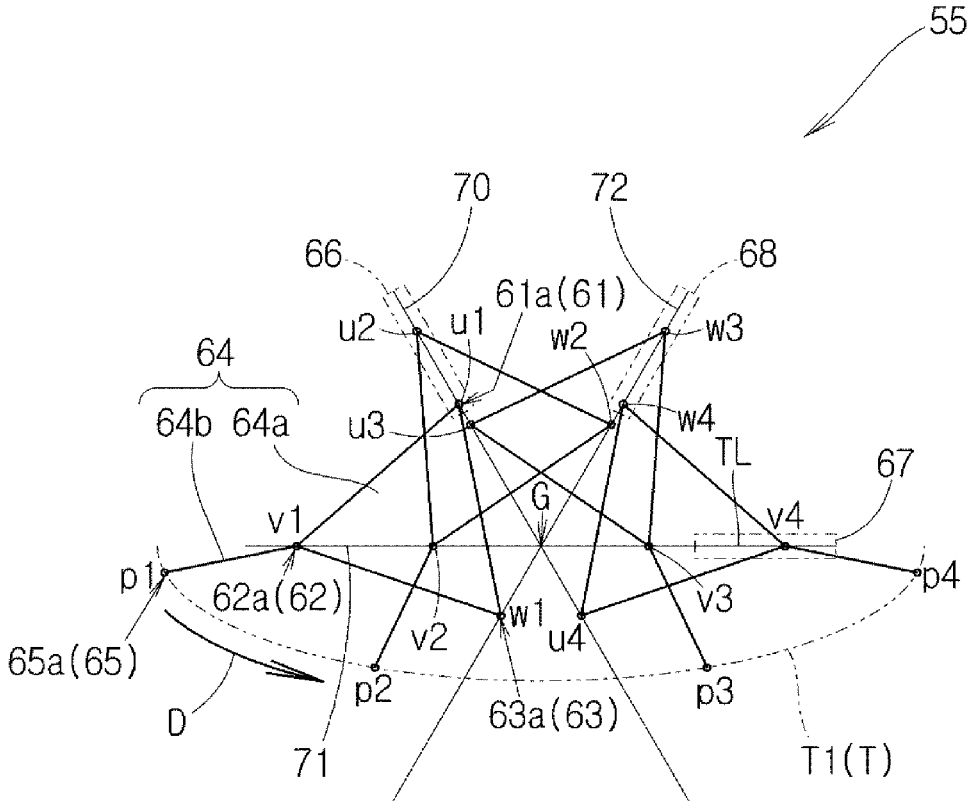
Fig. 19
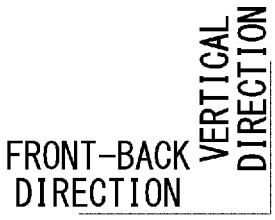

FRONT-BACK DIRECTION

VERTICAL DIRECTION

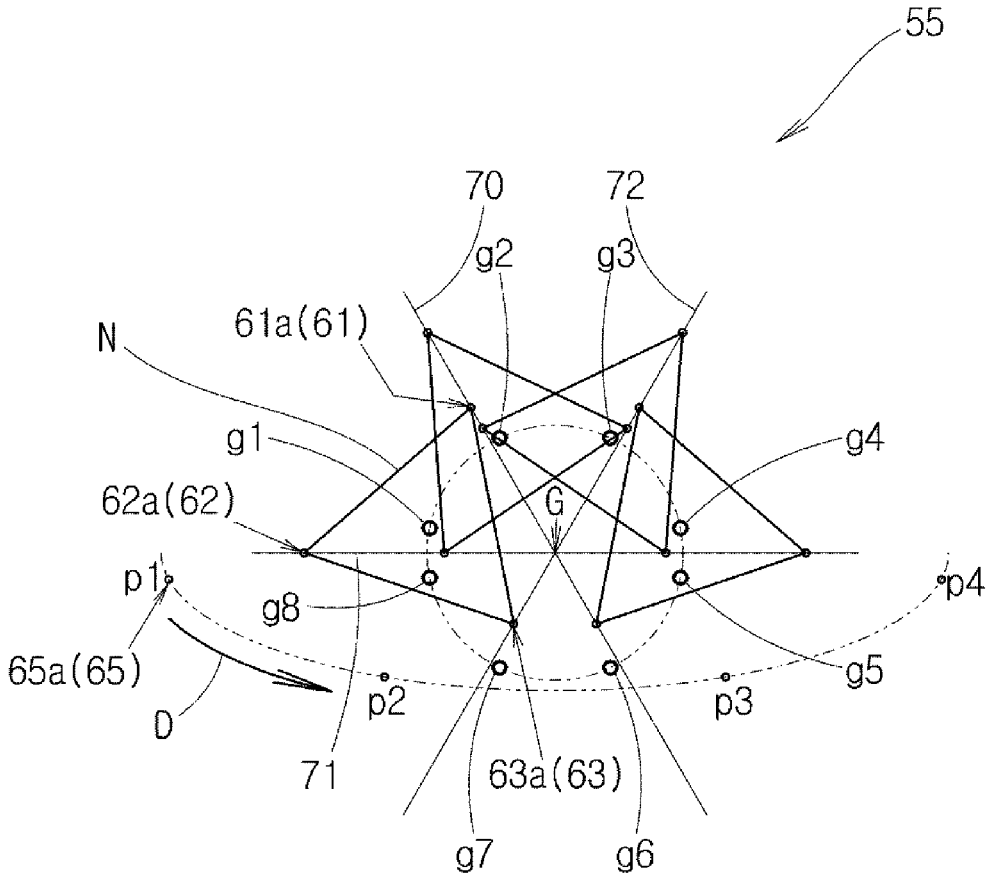
Fig. 21
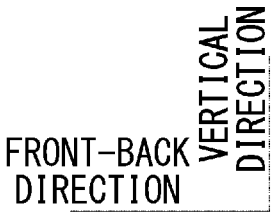

FRONT-BACK DIRECTION

VERTICAL DIRECTION

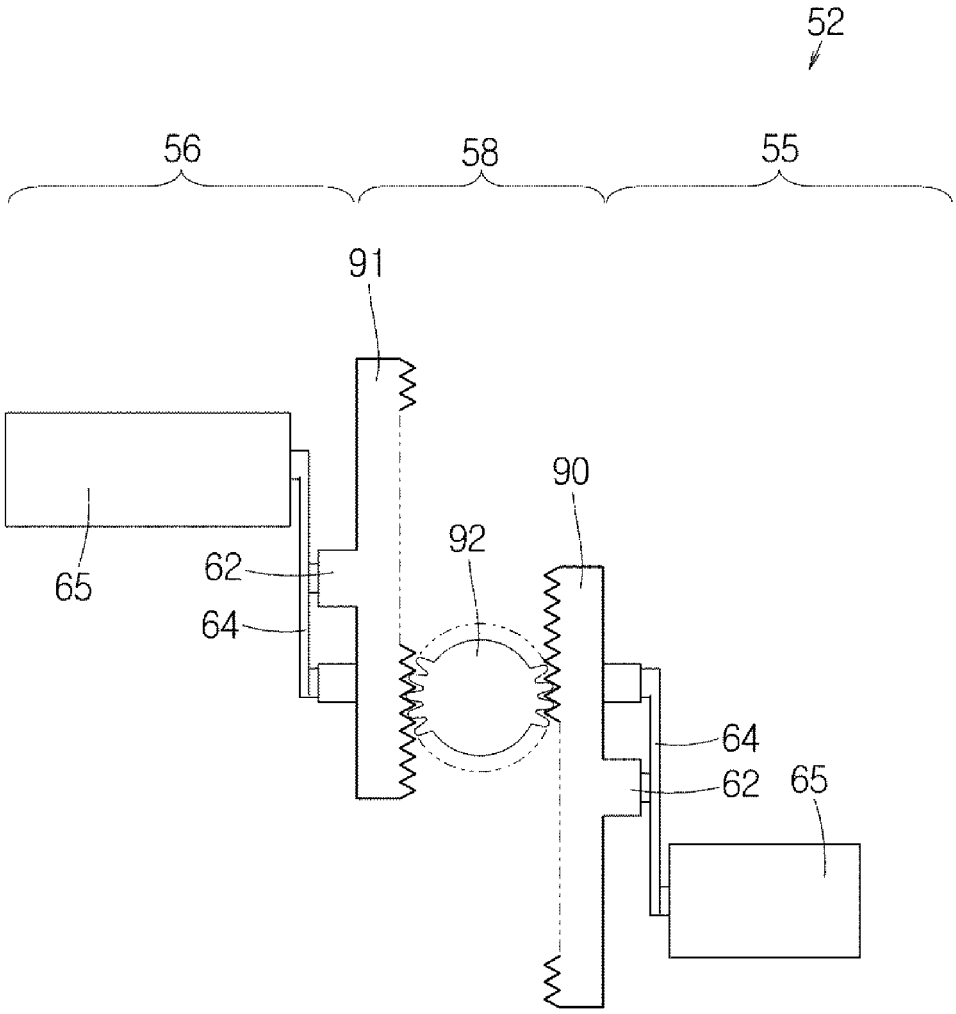
Fig. 23
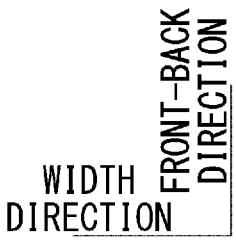

PEDAL SUPPORT STRUCTURE AND PEDAL SUPPORT SYSTEM

CROSS REFERENCE TO RELATED APPLICATIONS

This application is based upon and claims the benefit of priority from Japanese patent application No. 2022-74583, filed on Apr. 28, 2022, the disclosure of which is incorporated herein in its entirety by reference.

BACKGROUND

The present disclosure relates to a pedal support structure and a pedal support system.

Patent Literature 1 (Japanese Patent No. 2685131) discloses a sprint training machine including a movable pedestal for a right leg and a movable pedestal for a right leg. Each of the movable pedestals rotatably supports a rotation axis to which a pedal is attached via an arm. Each of the movable pedestals is able to reciprocate in the back-and-forth direction via a ball screw coupled to a servo motor. Then, an electromagnetic brake is coupled to the rotation axis via a chain. The electromagnetic brake is set in such a way that it applies a load to a rotation of the rotation axis when the pedal is located lower than the rotation axis and that it does not apply a load to the rotation of the rotation axis when the pedal is located higher than the rotation axis. According to the aforementioned configuration, the rotation axis of the arm is horizontally moved back and forth and the pedal is rotated about the rotation axis, and therefore the trajectory of the pedal is a rounded rectangle.

SUMMARY

By the way, it is generally preferable to install a foot-pedaling exercise equipment under a desk to eliminate the lack of daily exercise associated with desk work. That is, if a user uses the foot-pedaling exercise equipment to perform the foot-pedaling exercise in a seated position at his/her desk while working, it is possible to eliminate the lack of daily exercise without having to set aside time for exercise. Further, it is known that, when a human being walks, his/her foot moves as if it draws a substantially elliptical trajectory with respect to the pelvis when the foot is seen from a direction perpendicular to the sagittal plane. Therefore, if the rotation axis of the pedal can be moved along the elliptical trajectory in the aforementioned foot-pedaling exercise equipment, it would helpful to improve effects of the exercise using the foot-pedaling exercise equipment.

However, while the trajectory of the pedal can be a rounded rectangle in the aforementioned configuration of Patent Literature 1, the movable pedestals that reciprocate in the back-and-forth direction and the servo motor for reciprocating the movable pedestals in the back-and-forth direction are required. Therefore, an apparatus for obtaining the trajectory of the above pedal becomes complicated and the size thereof becomes large.

An object of the present disclosure is to provide a technique for moving a rotation axis of a pedal along an elliptical trajectory in a simple and compact manner.

According to a first aspect of the present disclosure, a pedal support structure including: a first slider; a second slider; a first guide that guides the first slider in such a way that the first slider can be slid linearly; a second guide that guides the second slider in such a way that the second slider can be slid linearly; a first coupling part to which the first slider and the second slider are rotatably coupled, thereby coupling the first slider and the second slider to each other; and a pedal rotatably coupled to the first coupling part, in which the first guide and the second guide are extended in such a way that they intersect with each other, a rotation axis of the pedal is disposed away from a rotation axis of the first slider and a rotation axis of the second slider and is disposed away from a midpoint of a line that connects the rotation axis of the first slider and the rotation axis of the second slider, whereby the rotation axis of the pedal moves along an elliptical trajectory is provided. According to the aforementioned configuration, it is possible to move a rotation axis of a pedal along an elliptical trajectory in a simple and compact manner.

The aforementioned pedal support structure may further include load means for applying a load to a movement of the first slider or the second slider. According to the aforementioned configuration, a user may mainly exercise muscle parts of the lower limb.

The load means may apply a load to the movement of the first slider or the second slider when the pedal is moved in a predetermined direction and the rotation axis of the pedal is located below the major axis of the elliptical trajectory, and does not apply a load to the movement of the first slider or the second slider when the pedal is moved in a predetermined direction and the rotation axis of the pedal is positioned above the major axis of the elliptical trajectory. According to the aforementioned configuration, load conditions specific to walking, that is, a load is not applied when a user swings his/her leg forward in a swing phase and a load is applied when the user kicks his/her leg backward in a stance phase, may be obtained.

The load means may apply a load to a movement of the first slider or the second slider in a direction that is away from the intersection of the first guide and the second guide. According to the aforementioned configuration, the load means may be configured in a simple manner.

The load means may be a spring that is provided in the first guide or the second guide and biases the first slider or the second slider toward the intersection. According to the aforementioned configuration, the load means may be configured in a simple manner.

The place on the first coupling part where the pedal is attached can be changed. According to the aforementioned configuration, it is possible to increase or decrease a major axis and a minor axis of the elliptical trajectory in a simple manner. Therefore, the major axis and the minor axis of the elliptical trajectory may be adjusted in accordance with the user's physique, and by increasing or decreasing the major axis and the minor axis of the elliptical trajectory, the muscle part that is used for the exercise may be changed and the efficiency of the exercise may be improved. Further, by increasing or decreasing the major axis and the minor axis of the elliptical trajectory, the range in which joint angles of mainly the hip joint, the knee joint, and the ankle joint are increased or decreased during the exercise is expanded or contracted as well, whereby it is possible to adjust the level of difficulty during the training for recovering the function of each of the joints.

A pedal support system comprising: a pedal support structure for a left leg as the aforementioned pedal support structure; and a pedal support structure for a right leg as the aforementioned pedal support structure, in which the pedal support structure for the left leg and the pedal support structure for the right leg are disposed so as to be opposed to each other is provided. According to the aforementioned configuration, the right and left legs can be trained simultaneously.

The aforementioned pedal support system may further include a linking mechanism that links the pedal of the pedal support structure for the left leg to the pedal of the pedal support structure for the right leg in such a way that the rotation axis of the pedal of the pedal support structure for the left leg and the rotation axis of the pedal of the pedal support structure for the right leg become point symmetrical with respect to the intersection of the first guide and the second guide of the pedal support structure for the left leg when the pedal support system is seen along the rotation axis of the pedal of the pedal support structure for the left leg. According to the aforementioned configuration, it is possible to simulate the movement of the right and left legs during walking more strictly.

The linking mechanism may include: a left-leg-side rack fixed to the second slider of the pedal support structure for the left leg; a right-leg-side rack fixed to the second slider of the pedal support structure for the right leg; and a pinion that meshes with the left-leg-side rack and the right-leg-side rack. According to the aforementioned configuration, the linking mechanism may be obtained with a simple configuration.

The linking mechanism may include: a base shaft rotatably supported; a left-leg-side crank arm and a right-leg-side crank arm extended from the base shaft, the left-leg-side crank arm being extended from the base shaft in a direction opposite to that in which the right-leg-side crank arm is extended; a left-leg-side second coupling part to which the first slider and the second slider of the pedal support structure for the left leg are rotatably coupled, thereby coupling the first slider and the second slider of the pedal support structure for the left leg to each other; and a right-leg-side second coupling part to which the first slider and the second slider of the pedal support structure for the right leg are rotatably coupled, thereby coupling the first slider and the second slider of the pedal support structure for the right leg to each other, in which the left-leg-side crank arm is rotatably coupled to the left-leg-side second coupling part at the midpoint of the pedal support structure for the left leg, and the right-leg-side crank arm may be rotatably coupled to the right-leg-side second coupling part at the midpoint of the pedal support structure for the right leg. According to the aforementioned configuration, the linking mechanism may be obtained with a simple configuration.

According to a second aspect of the present disclosure, a pedal support structure comprising: a first slider, a second slider, a third slider, a first guide that guides the first slider in such a way that the first slider can be slid linearly; a second guide that guides the second slider in such a way that the second slider can be slid linearly; a third guide that guides the third slider in such a way that the third slider can be slid linearly; a first coupling part to which the first slider, the second slider, and the third slider are rotatably coupled, thereby coupling the first slider, the second slider, and the third slider to one another; and a pedal rotatably coupled to the first coupling part, in which the first guide, the second guide, and the third guide are extended in such a way that they intersect with one another at one point, and a rotation axis of the pedal is disposed away from a rotation axis of the first slider, a rotation axis of the second slider, and a rotation axis of the third slider and is disposed away from the center of gravity of a triangle that connects the rotation axis of the first slider, the rotation axis of the second slider, and the rotation axis of the third slider, whereby the rotation axis of the pedal moves along an elliptical trajectory is provided. According to the aforementioned configuration, it is possible to move a rotation axis of a pedal along an elliptical trajectory in a simple and compact manner.

The aforementioned pedal support structure may further include load means for applying a load to a movement of the first slider, the second slider, or the third slider. According to the aforementioned configuration, a user may mainly exercise muscle parts of the lower limb.

The load means may apply a load to the movement of the first slider, the second slider, or the third slider when the pedal is moved in a predetermined direction and the rotation axis of the pedal is located below the major axis of the elliptical trajectory, and does not apply a load to the movement of the first slider, the second slider, or the third slider when the pedal is moved in a predetermined direction and the rotation axis of the pedal is positioned above the major axis of the elliptical trajectory. According to the aforementioned configuration, load conditions specific to walking, that is, a load is not applied when a user swings his/her leg forward in a swing phase and a load is applied when the user kicks his/her leg backward in a stance phase, may be obtained.

The load means may apply a load to a movement of the first slider, the second slider, or the third slider in a direction away from the intersection of the first guide, the second guide, and the third guide.

According to the aforementioned configuration, the load means may be configured in a simple manner.

The load means may be a spring that is disposed in the first guide, the second guide, or the third guide and biases the first slider, the second slider, or the third slider toward the intersection. According to the aforementioned configuration, the load means may be configured in a simple manner.

The place on the first coupling part where the pedal is attached may be changed. According to the aforementioned configuration, it is possible to increase or decrease a major axis and a minor axis of the elliptical trajectory in a simple manner. Therefore, the major axis and the minor axis of the elliptical trajectory may be adjusted in accordance with the user's physique, and by increasing or decreasing the major axis and the minor axis of the elliptical trajectory, the muscle part that is used for the exercise may be changed and the efficiency of the exercise may be improved. Further, by increasing or decreasing the major axis and the minor axis of the elliptical trajectory, the range in which the joint angles of mainly the hip joint, the knee joint, and the ankle joint increases or decreases during the exercise is expanded or contracted as well, whereby it is possible to adjust the level of difficulty during the training for recovering the function of each of the joints.

A pedal support system including: a pedal support structure for a left leg as the aforementioned pedal support structure; and a pedal support structure for a right leg as the aforementioned pedal support structure, in which the pedal support structure for the left leg and the pedal support structure for the right leg are disposed so as to be opposed to each other is provided. According to the aforementioned configuration, the right and left legs can be trained simultaneously.

The aforementioned pedal support system may further include a linking mechanism that links the pedal of the pedal support structure for the left leg to the pedal of the pedal support structure for the right leg in such a way that the rotation axis of the pedal of the pedal support structure for the left leg and the rotation axis of the pedal of the pedal support structure for the right leg become point symmetrical with respect to the intersection of the first guide, the second guide, and the third guide of the pedal support structure for the left leg when the pedal support system is seen along the rotation axis of the pedal of the pedal support structure for the left leg. According to the aforementioned configuration, it is possible to simulate the movement of the right and left legs during walking more strictly.

The linking mechanism may include a left-leg-side rack fixed to the second slider of the pedal support structure for the left leg; a right-leg-side rack fixed to the second slider of the pedal support structure for the right leg; and a pinion that meshes with the left-leg-side rack and the right-leg-side rack. According to the aforementioned configuration, the linking mechanism may be obtained with a simple configuration.

The linking mechanism may include: a base shaft rotatably supported; a left-leg-side crank arm and a right-leg-side crank arm extended from the base shaft, the left-leg-side crank arm being extended from the base shaft in a direction opposite to that in which the right-leg-side crank arm is extended; a left-leg-side second coupling part to which the first slider, the second slider, and the third slider of the pedal support structure for the left leg are rotatably coupled, thereby coupling the first slider, the second slider, and the third slider of the pedal support structure for the left leg to one another, a right-leg-side second coupling part to which the first slider, the second slider, and the third slider of the pedal support structure for the right leg are rotatably coupled, thereby coupling the first slider, the second slider, and the third slider of the pedal support structure for the right leg to one another, wherein the left-leg-side crank arm is rotatably coupled to the left-leg-side second coupling part at the center of gravity of the pedal support structure for the left leg, and the right-leg-side crank arm is rotatably coupled to the right-leg-side second coupling part at the center of gravity of the pedal support structure for the right leg. According to the aforementioned configuration, the linking mechanism may be obtained with a simple configuration.

According to the present disclosure, it is possible to move a rotation axis of a pedal along an elliptical trajectory in a simple and compact manner.

The above and other objects, features and advantages of the present disclosure will become more fully understood from the detailed description given hereinbelow and the accompanying drawings which are given by way of illustration only, and thus are not to be considered as limiting the present disclosure.

BRIEF DESCRIPTION OF DRAWINGS

FIG. 11 is a diagram showing a relation between a position where a pedal is attached and the size of an elliptical trajectory (first embodiment);

FIG. 15 is a perspective view of the foot-pedaling exercise equipment in which a guide is not shown (second embodiment);

FIG. 16 is a perspective view of the foot-pedaling exercise equipment in which the guide is not shown when the foot-pedaling exercise equipment is seen from another angle (second embodiment);

FIG. 19 is a diagram for describing a lower-route trajectory of the pedal (second embodiment);

FIG. 21 is a diagram for describing a trajectory of a center of gravity (second embodiment);

FIG. 23 is a plan view showing another specific example of a linking unit (modified example)

DESCRIPTION OF EMBODIMENTS

First Embodiment

Figure 1:
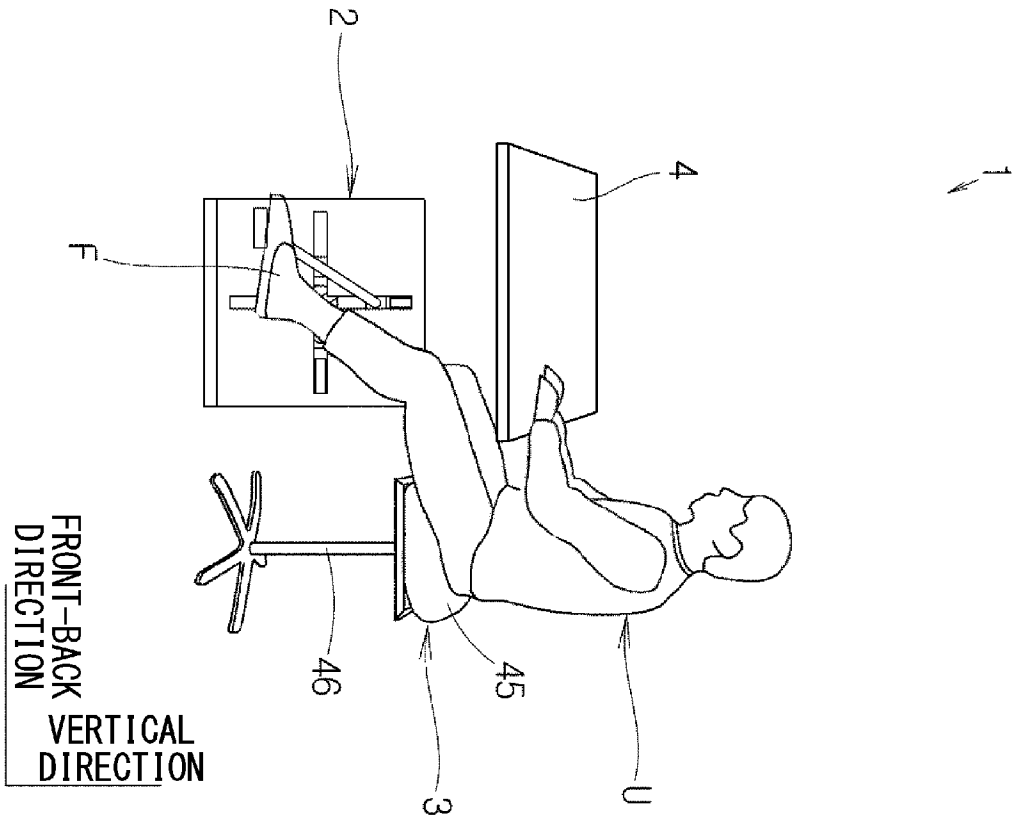
FIG. 1 is a side view of a foot-pedaling exercise system (first embodiment)

Hereinafter, with reference to FIGS. 1 to 11, a first embodiment of the present disclosure will be described. FIG. 1 shows a foot-pedaling exercise system 1. As shown in FIG. 1, the foot-pedaling exercise system 1 includes a foot-pedaling exercise equipment 2 and a chair 3. The foot-pedaling exercise equipment 2 is one specific example of a pedal support system. A user U who is seated on the chair 3 does desk work using a laptop computer (not shown) placed on a desk 4. The foot-pedaling exercise equipment 2 that is compact in size is placed under the desk 4. Therefore, the user U can perform a foot-pedaling exercise using the foot-pedaling exercise equipment 2 during the desk work.

Now, the terms "front-back direction" and "width direction" used herein are defined. The "front-back direction" is a horizontal direction in which the user U swings or kicks his/her foot F. Therefore, the "front-back direction" may be defined to be a direction that is perpendicular to the coronal plane of the user U. The front-back direction includes a front side and a back side. The front side is a direction in which the user U swings his/her foot F. The back side is a direction in which the user U kicks his/her foot F. The "width direction" is a horizontal direction that is perpendicular to the front-back direction. Therefore, the width direction is a direction that is substantially perpendicular to the paper of FIG. 1. Since the front-back direction and the width direction are both horizontal directions, they are both perpendicular to the vertical direction.

FIGS. 2 to 7 show the foot-pedaling exercise equipment 2. As shown in FIGS. 2 to 7, the foot-pedaling exercise equipment 2 includes a left leg unit 5, a right leg unit 6, a pedestal 7, and a linking unit 8. The left leg unit 5 and the right leg unit 6 are specific examples of a pedal support structure. The left leg unit 5 is one specific example of a pedal support structure for a left leg. The right leg unit 6 is one specific example of a pedal support structure for a right leg. The linking unit 8 is one specific example of a linking mechanism.

As shown in FIGS. 2 to 7, the left leg unit 5 includes a guide 10, a vertical piece 11, a horizontal piece 12, an outer coupling bar 13, a pedal 14, a vertical coil spring 15, and a horizontal coil spring 16.

The vertical piece 11 is one specific example of a first slider. The horizontal piece 12 is one specific example of a second slider. The outer coupling bar 13 is one specific example of a first coupling part. The vertical coil spring 15 and the horizontal coil spring 16 are specific examples of load means. That is, the load means is formed of the vertical coil spring 15 and the horizontal coil spring 16.

Figure 2:
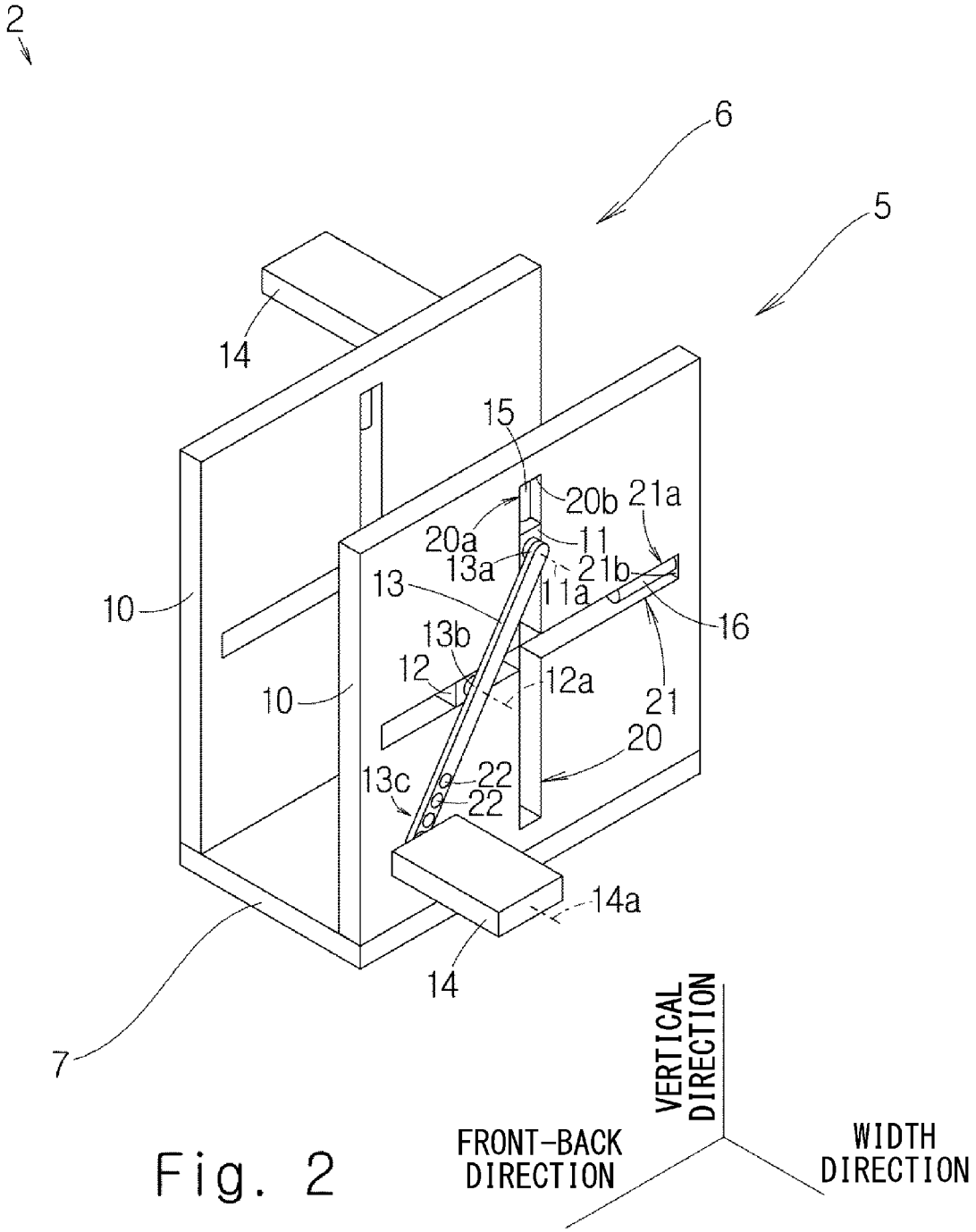
FIG. 2 is a perspective view of a foot-pedaling exercise equipment (first embodiment)
Figure 7:
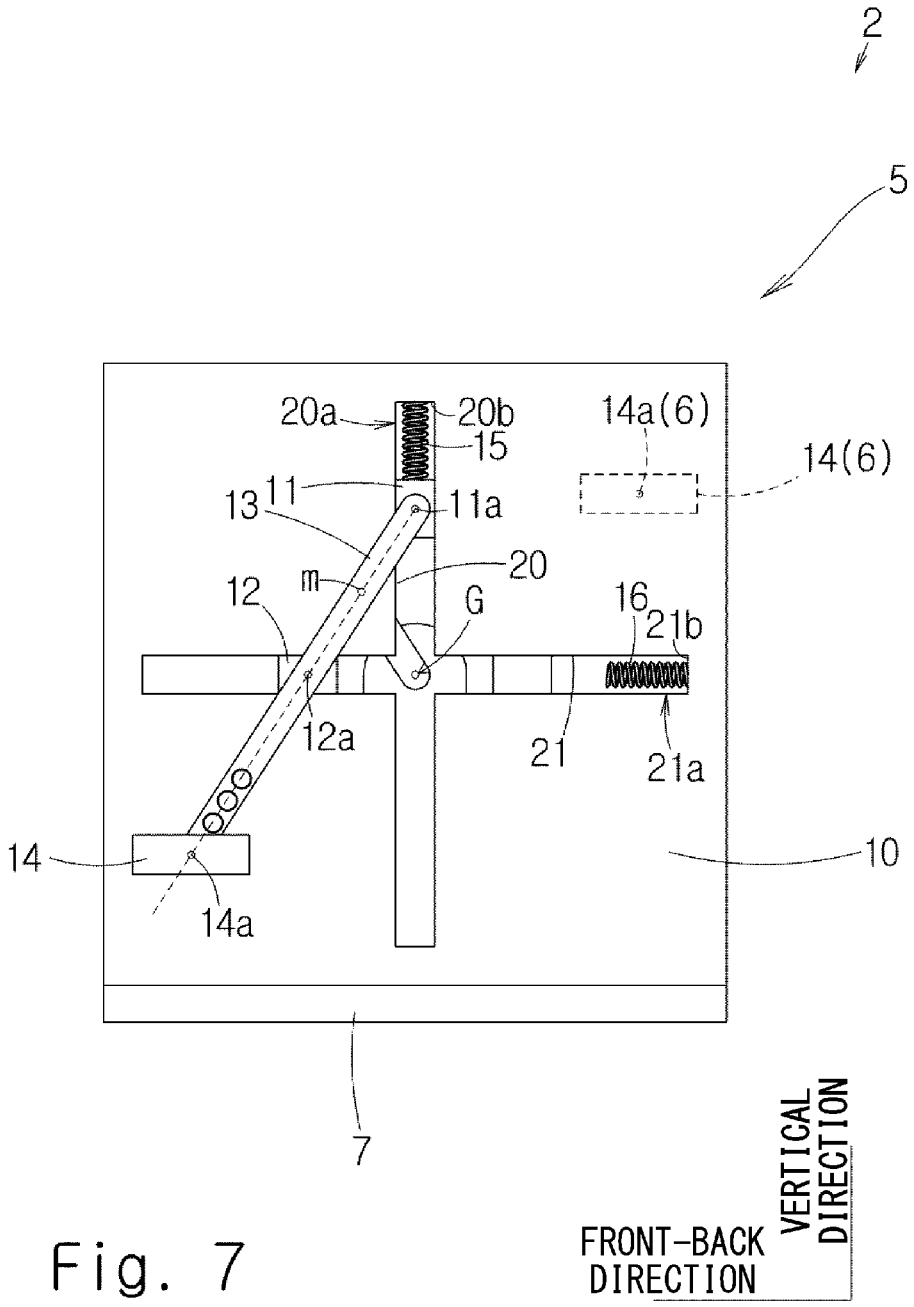
FIG. 7 is a side view of the foot-pedaling exercise equipment (first embodiment)

As shown in FIGS. 2 and 7, in this embodiment, the guide 10 is formed of, for example, a metallic plate body. The thickness direction of the guide 10 is the same as the width direction. A vertical guide groove 20 and a horizontal guide groove 21 are formed in the guide 10. The vertical guide groove 20 is one specific example of a first guide. The horizontal guide groove 21 is one specific example of a second guide.

The vertical guide groove 20 is formed to be linearly extended in the vertical direction. The horizontal guide groove 21 is formed to be linearly extended in the front-back direction. The vertical guide groove 20 and the horizontal guide groove 21 are extended in such a way that they intersect with each other when the guide 10 is seen along the width direction, that is, in a side view. Therefore, the vertical guide groove 20 and the horizontal guide groove 21 intersect with each other so that they form a cross shape in a side view.

The vertical guide groove 20 supports the vertical piece 11 in such a way that the vertical piece 11 can be slid linearly along the vertical direction. The vertical guide groove 20 prohibits the vertical piece 11 from moving in the front-back direction and the width direction. The vertical guide groove 20 restrains the vertical piece 11 in the width direction so as to prevent the vertical piece 11 from being fallen off from the vertical guide groove 20 in the width direction. Generally, a groove that is extended in the vertical direction is provided on the inner wall surface of the vertical guide groove 20, and the vertical piece 11 is fitted into this groove, whereby the vertical piece 11 can be restrained as described above. The vertical coil spring 15 is accommodated in an upper end 20*a* of the vertical guide groove 20. The vertical coil spring 15 is accommodated in the upper end 20*a* of the vertical guide groove 20 in a posture in which the pitch direction matches the vertical direction. The upper end of the vertical coil spring 15 is fixed to an upper partition surface 20*b* that partitions the vertical guide groove 20 in the vertical direction. In general, the vertical coil spring 15 is a compression coil spring.

The horizontal guide groove 21 supports the horizontal piece 12 in such a way that the horizontal piece 12 can be slid linearly along the front-back direction. The horizontal guide groove 21 prohibits the horizontal piece 12 from moving in the vertical direction and the width direction. The horizontal guide groove 21 restrains the horizontal piece 12 in the width direction so as to prevent the horizontal piece 12 from being fallen off from the horizontal guide groove 21 in the width direction. Generally, a groove that is extended in the front-back direction is provided on the inner wall surface of the horizontal guide groove 21, and the horizontal piece 12 is fitted into this groove, whereby the horizontal piece 12 can be restrained as described above. The horizontal coil spring 16 is accommodated in a rear end 21*a* of the horizontal guide groove 21. The horizontal coil spring 16 is accommodated in the rear end 21*a* of the horizontal guide groove 21 in a posture in which the pitch direction matches the front-back direction. The rear end of the horizontal coil spring 16 is fixed to a back partition surface 21*b* that partitions the horizontal guide groove 21 in the front-back direction. In general, the horizontal coil spring 16 is a compression coil spring.

Since the vertical guide groove 20 and the horizontal guide groove 21 intersect with each other, the vertical coil spring 15 that slides in the vertical guide groove 20 in the vertical direction locally passes through the inner space of the horizontal coil spring 16 and the horizontal coil spring 16 that slides in the horizontal guide groove 21 in the front-back direction locally passes through the inner space of the vertical coil spring 15.

The outer coupling bar 13 couples the vertical piece 11 and the horizontal piece 12 to each other. The outer coupling bar 13 is disposed outward of the guide 10 in the width direction. The expression "outward in the width direction" that is used to explain the left leg unit 5 means a width direction that is away from the right leg unit 6. The vertical piece 11, the horizontal piece 12, and the pedal 14 are rotatably (they can freely conduct a pitch turn) coupled to the outer coupling bar 13. Therefore, the vertical piece 11 includes a rotation axis 11*a* with respect to the outer coupling bar 13. The rotation axis 11*a* is extended in the width direction. Likewise, the horizontal piece 12 includes a rotation axis 12*a* with respect to the outer coupling bar 13. The rotation axis 12*a* is extended in the width direction. Likewise, the pedal 14 includes a rotation axis 14*a* with respect to the outer coupling bar 13. The rotation axis 14*a* is extended in the width direction.

The outer coupling bar 13 includes a vertical piece coupling part 13*a* to which the vertical piece 11 is rotatably coupled, a horizontal piece coupling part 13*b* to which the horizontal piece 12 is rotatably coupled, and a pedal coupling part 13*c* to which the pedal 14 is rotatably coupled. The outer coupling bar 13 is extended in such a way that the vertical piece coupling part 13*a*, the horizontal piece coupling part 13*b*, and the pedal coupling part 13*c* are aligned in one line. The pedal coupling part 13*c* is positioned on the side opposite to the vertical piece coupling part 13*a* with the horizontal piece coupling part 13*b* held therebetween. That is, the horizontal piece coupling part 13*b* is positioned between the vertical piece coupling part 13*a* and the pedal coupling part 13*c*.

A plurality of fitting parts 22 to or from which the pedal 14 can be attached or detached are formed in the pedal coupling part 13*c*. The plurality of fitting parts 22 are formed in a line along the longitudinal direction of the outer coupling bar 13. Therefore, the place on the outer coupling bar 13 where the pedal 14 is attached can be changed. When, for example, the pedal 14 is attached to one of the plurality of fitting parts 22 that is the closest to the horizontal piece coupling part 13*b*, the distance between the rotation axis 14*a* of the pedal 14 and the rotation axis 12*a* of the horizontal piece 12 can be made the shortest. On the other hand, when the pedal 14 is attached to one of the plurality of fitting parts 22 that is the farthest from the horizontal piece coupling part 13*b*, the distance between the rotation axis 14*a* of the pedal 14 and the rotation axis 12*a* of the horizontal piece 12 can be made the largest.

As shown in FIG. 7, no matter to which one of the plurality of fitting parts 22 the pedal 14 is attached, the rotation axis 14*a* of the pedal 14 is disposed away from the rotation axis 11*a* of the vertical piece 11 and the rotation axis 12*a* of the horizontal piece 12. Furthermore, the rotation axis 14*a* of the pedal 14 is disposed away from a midpoint m of the line that connects the rotation axis 11*a* of the vertical piece 11 and the rotation axis 12*a* of the horizontal piece 12 in a side view. Therefore, while the details will be described later, the trajectory along which the rotation axis 14*a* of the pedal 14 moves is an elliptical trajectory in which the front-back direction corresponds to a major axis and the vertical direction corresponds to a minor axis in a side view.

Figure 3:
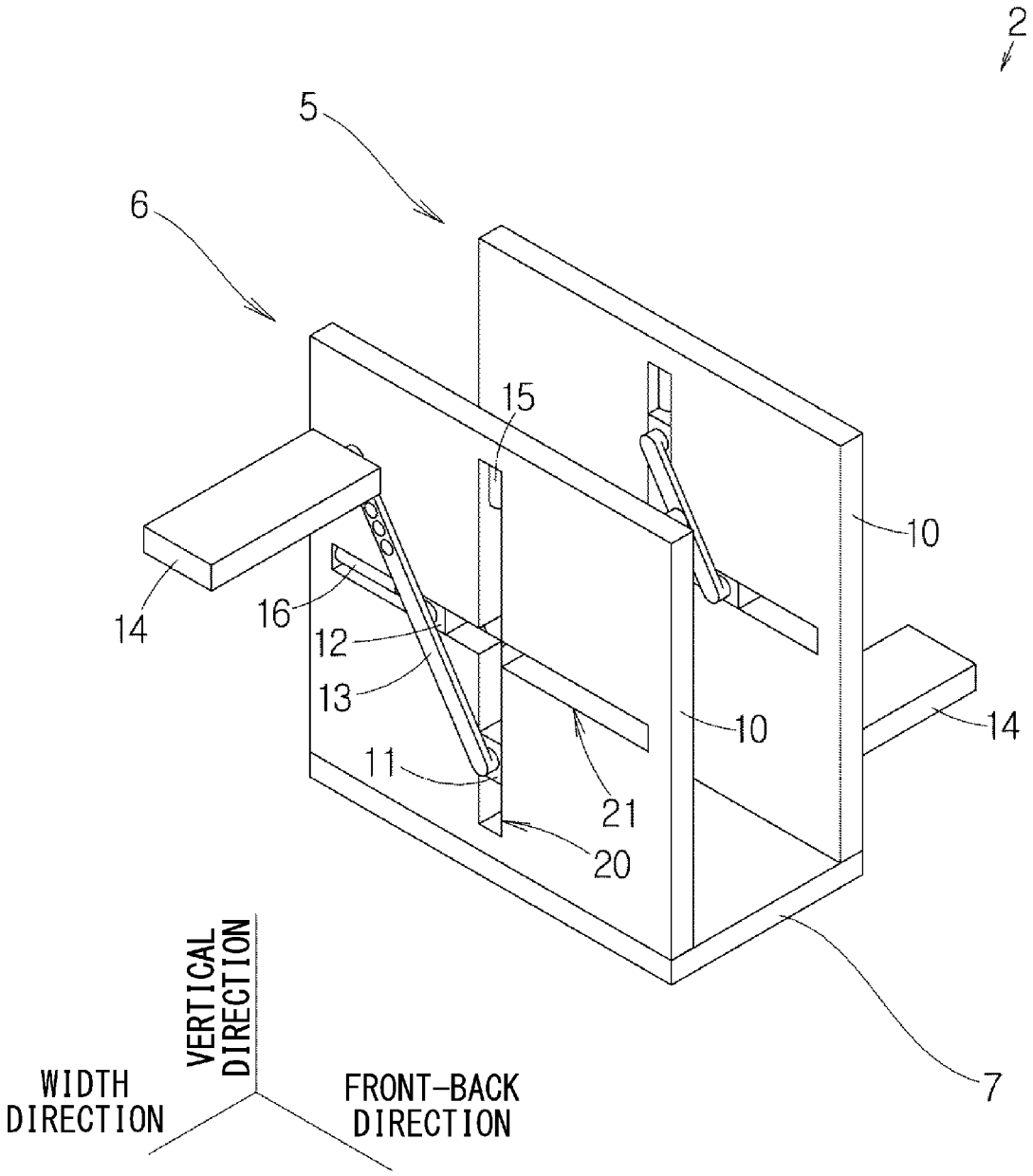
FIG. 3 is a perspective view of the foot-pedaling exercise equipment when it is seen from another angle (first embodiment)

As shown in FIG. 3, like in the left leg unit 5, the right leg unit 6 includes a guide 10, a vertical piece 11, a horizontal piece 12, an outer coupling bar 13, a pedal 14, a vertical coil spring 15, and a horizontal coil spring 16. Since the configuration of the right leg unit 6 is symmetrical to the configuration of the left leg unit 5 described above with respect to the sagittal plane, the description thereof will be omitted.

Referring once again to FIG. 2, the pedestal 7 couples the left leg unit 5 to the right leg unit 6 that are disposed so as to be opposed to each other in the width direction. Specifically, the pedestal 7 is formed of a metallic plate body that couples the guide 10 of the left leg unit 5 to the guide 10 of the right leg unit 6.

Figure 4:
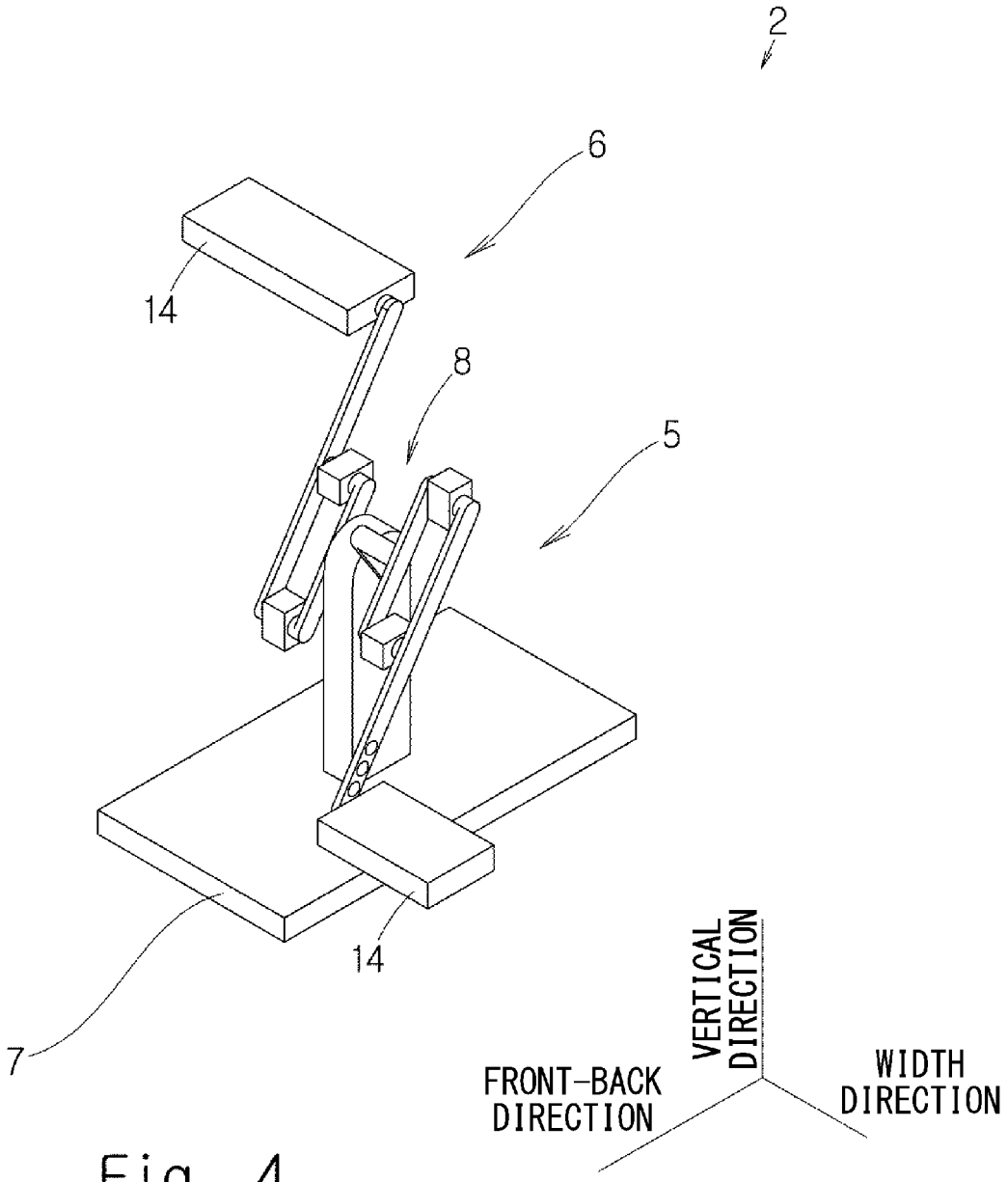
FIG. 4 is a perspective view of the foot-pedaling exercise equipment in which a guide is not shown (first embodiment)
Figure 5:
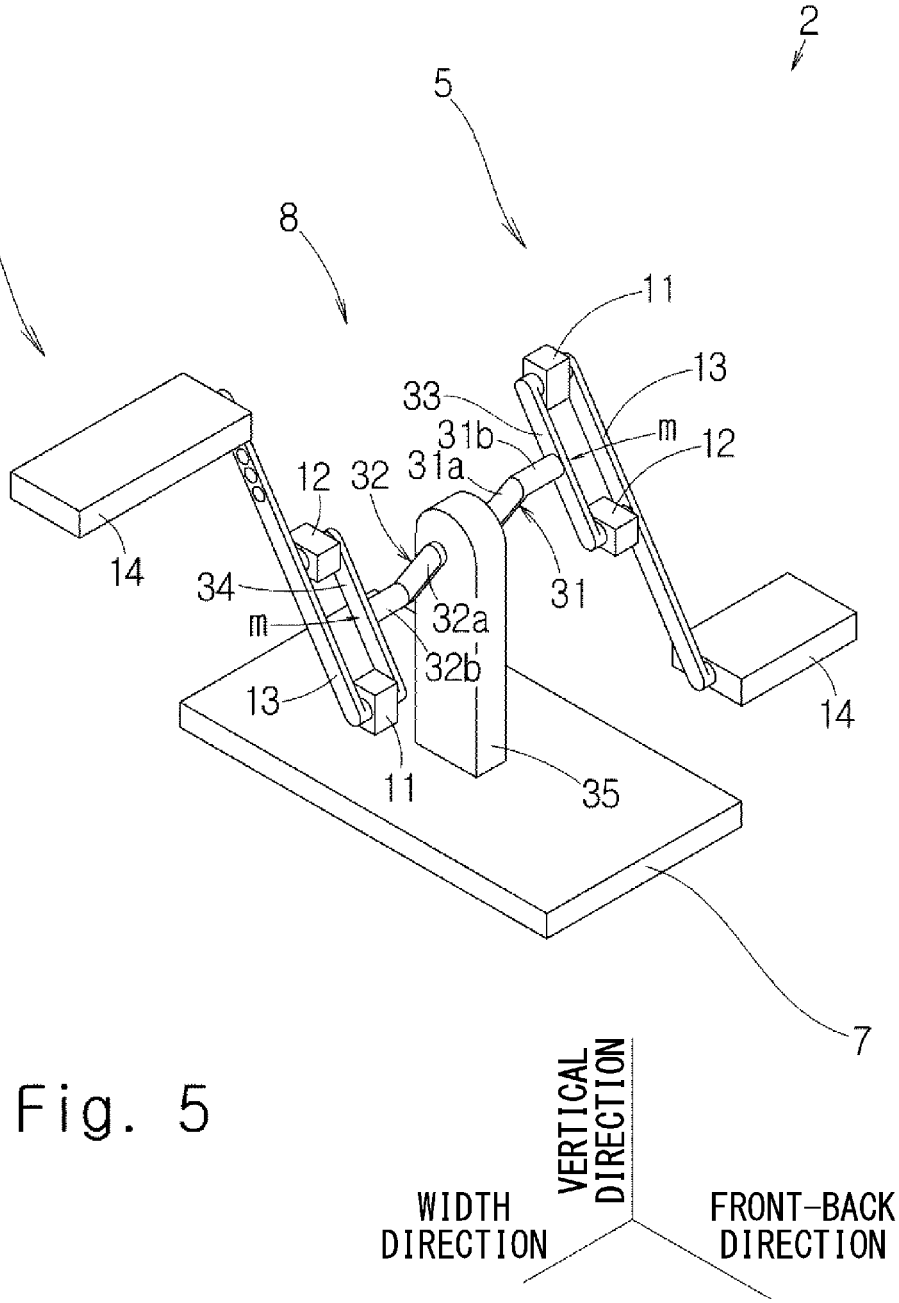
FIG. 5 is a perspective view of the foot-pedaling exercise equipment in which the guide is not shown when the foot-pedaling exercise equipment is seen from another angle (first embodiment)
Figure 6:
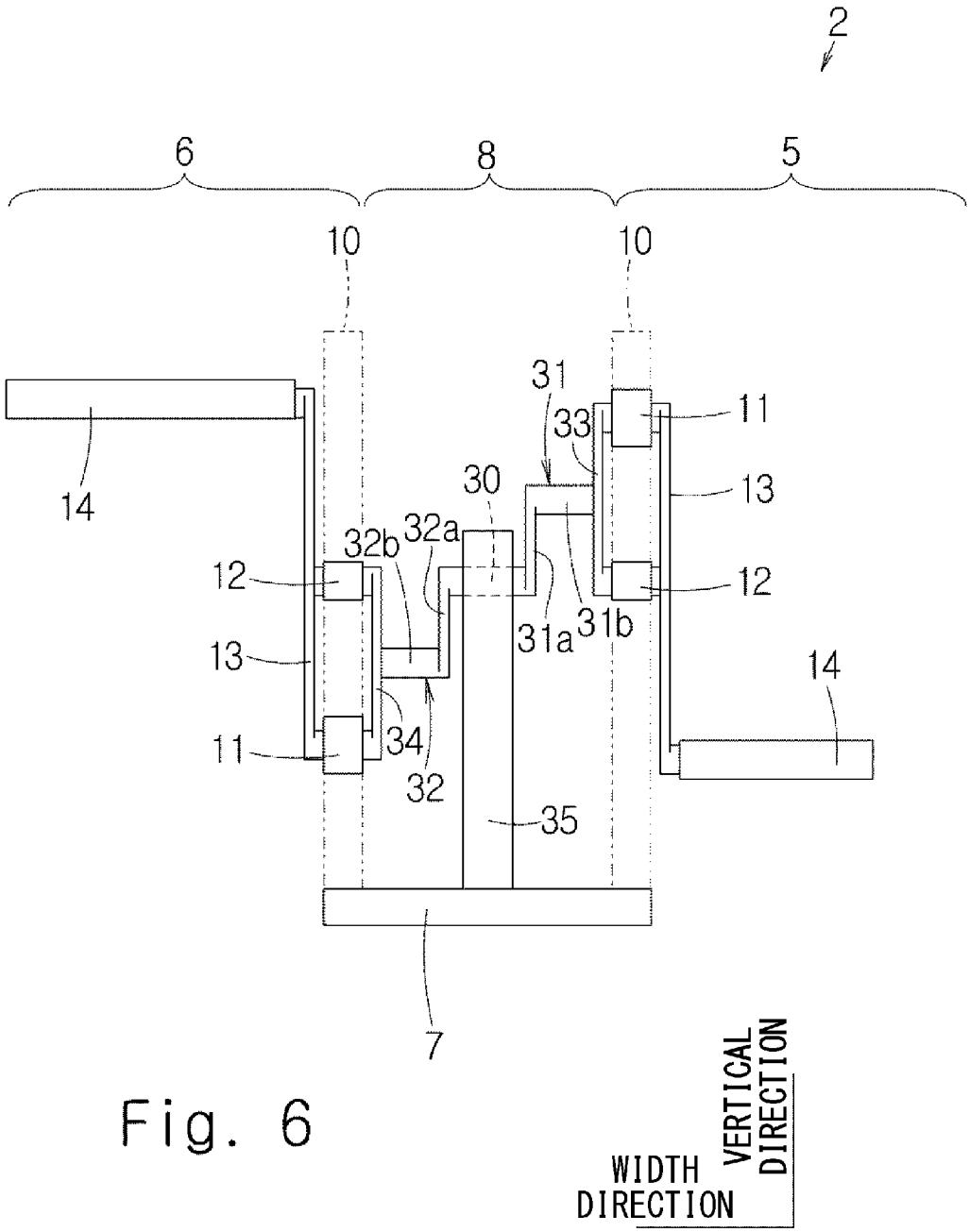
FIG. 6 is a front view of the foot-pedaling exercise equipment (first embodiment)

As shown in FIGS. 4 to 6, the linking unit 8 links the left-leg foot-pedaling exercise in the left leg unit 5 and the right-leg foot-pedaling exercise in the right leg unit 6 to each other. That is, the linking unit 8 links the pedal 14 of the left leg unit 5 and the pedal 14 of the right leg unit 6 to each other. The linking unit 8 is provided between the left leg unit 5 and the right leg unit 6 in the width direction.

As shown in FIGS. 5 and 6, the linking unit 8 includes a base shaft 30, a left-leg-side crank arm 31, a right-leg-side crank arm 32, a left-leg-side inner coupling bar 33, and a right-leg-side inner coupling bar 34.

The base shaft 30, which is a shaft that is extended in a width direction, is rotatably supported by a support pillar 35 that is projected upward from the pedestal 7.

The left-leg-side crank arm 31 and the right-leg-side crank arm 32 are extended from the base shaft 30 in the directions opposite to each other.

Specifically, the left-leg-side crank arm 31 includes a crank arm body 31*a* and a horizontal extension part 31*b*. The crank arm body 31*a* is extended from an end part of the base shaft 30 on the side of the left leg unit 5. The crank arm body 31*a* is extended in the direction that is perpendicular to the longitudinal direction of the base shaft 30. The horizontal extension part 31*b* is extended outward in the width direction from a tip of the crank arm body 31*a*.

Likewise, the right-leg-side crank arm 32 includes a crank arm body 32*a* and a horizontal extension part 32*b*. The crank arm body 32*a* is extended from an end part of the base shaft 30 on the side of the right leg unit 6. The crank arm body 32*a* is extended in the direction that is perpendicular to the longitudinal direction of the base shaft 30. The horizontal extension part 32*b* is extended in the outward in the width direction from a tip of the crank arm body 32*a*.

As shown in FIGS. 5 and 6, the crank arm body 31*a* of the left-leg-side crank arm 31 and the crank arm body 32*a* of the right-leg-side crank arm 32 are extended in the direction that is perpendicular to the longitudinal direction of the base shaft 30, the left-leg-side crank arm 31 being extended in a direction opposite to that in which the right-leg-side crank arm 32 is extended.

Like the outer coupling bar 13 of the left leg unit 5, the left-leg-side inner coupling bar 33 couples the vertical piece 11 and the horizontal piece 12 of the left leg unit 5 to each other. The left-leg-side inner coupling bar 33 is disposed inward of the guide 10 of the left leg unit 5 in the width direction. Therefore, the guide 10 of the left leg unit 5 is held between the outer coupling bar 13 of the left leg unit 5 and the left-leg-side inner coupling bar 33 in the width direction. The vertical piece 11 and the horizontal piece 12 of the left leg unit 5 are rotatably (they can freely conduct a pitch turn) coupled to the left-leg-side inner coupling bar 33.

Like the outer coupling bar 13 of the right leg unit 6, the right-leg-side inner coupling bar 34 couples the vertical piece 11 and the horizontal piece 12 of the right leg unit 6 to each other. The right-leg-side inner coupling bar 34 is disposed inward of the guide 10 of the right leg unit 6 in the width direction. Therefore, the guide 10 of the right leg unit 6 is held between the outer coupling bar 13 of the right leg unit 6 and the right-leg-side inner coupling bar 34 in the width direction. The vertical piece 11 and the horizontal piece 12 of the right leg unit 6 are rotatably (they can freely conduct a pitch turn) coupled to the right-leg-side inner coupling bar 34.

Referring continuously to FIGS. 5 to 7, the horizontal extension part 31*b* of the left-leg-side crank arm 31 is rotatably (it can freely conduct a pitch turn) coupled to the left-leg-side inner coupling bar 33 at a midpoint m of the line that connects the rotation axis 11*a* of the vertical piece 11 and the rotation axis 12*a* of the horizontal piece 12 of the left leg unit 5 in a side view of FIG. 7. That is, the horizontal extension part 31*b* of the left-leg-side crank arm 31 is rotatably (it can freely conduct a pitch turn) coupled to the left-leg-side inner coupling bar 33 at the center of the left-leg-side inner coupling bar 33 in the longitudinal direction.

Likewise, as shown in FIG. 5, the horizontal extension part 32*b* of the right-leg-side crank arm 32 is rotatably (it can freely conduct a pitch turn) coupled to the right-leg-side inner coupling bar 34 at a midpoint m of the line that connects the rotation axis 11*a* of the vertical piece 11 and the rotation axis 12*a* of the horizontal piece 12 of the right leg unit 6 in a side view. That is, the horizontal extension part 32*b* of the right-leg-side crank arm 32 is rotatably (it can freely conduct a pitch turn) coupled to the right-leg-side inner coupling bar 34 at the center of the right-leg-side inner coupling bar 34 in the longitudinal direction.

By coupling the left leg unit 5 to the right leg unit 6 via the aforementioned linking unit 8, as shown in FIG. 7, the pedal 14 of the left leg unit 5 and the pedal 14 of the right leg unit 6 are linked to each other in phases opposite to each other. That is, as shown in FIG. 7, in a side view, a positional relation in which the rotation axis 14*a* of the pedal 14 of the left leg unit 5 and the rotation axis 14*a* of the pedal 14 of the right leg unit 6 become point symmetrical to each other with respect to the an intersection G of the vertical guide groove 20 and the horizontal guide groove 21 of the left leg unit 5 is always established during the foot-pedaling exercise.

Figure 8:
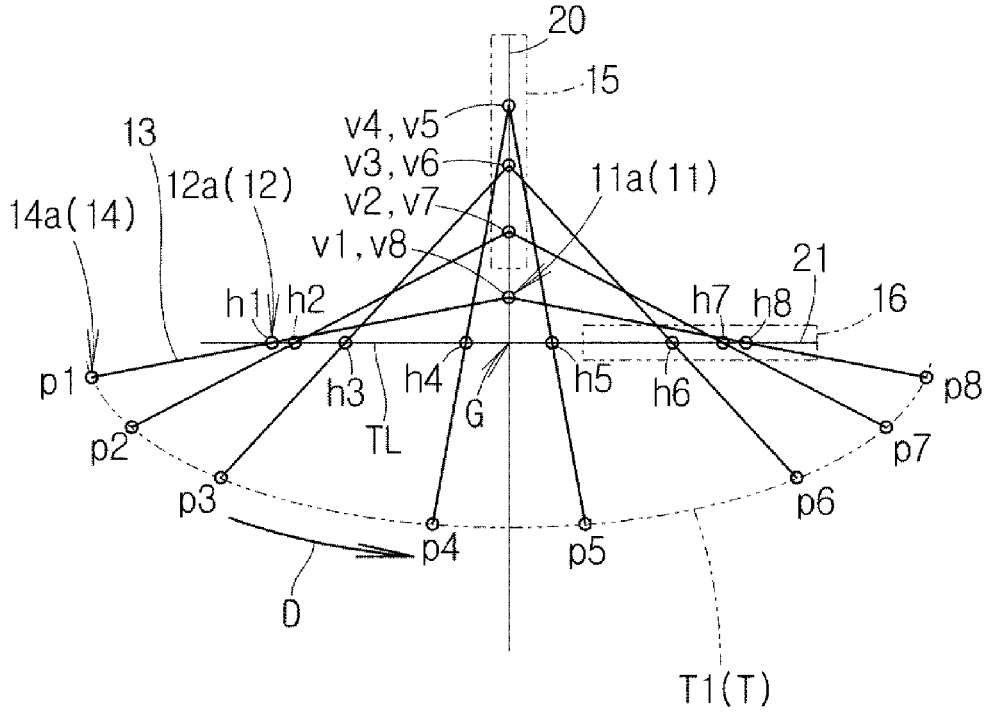
FIG. 8 is a diagram for describing a lower-route trajectory of a pedal (first embodiment)
Figure 9:
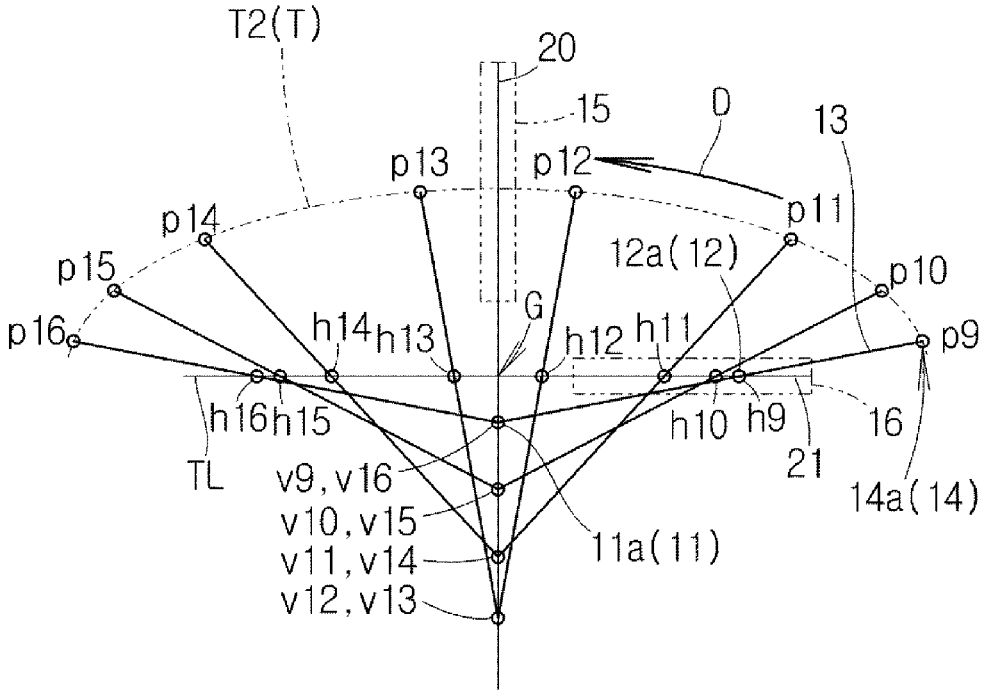
FIG. 9 is a diagram for describing an upper-route trajectory of the pedal (first embodiment)

Referring next to FIGS. 8 and 9, a mechanism in which the left leg unit 5 achieves an elliptical trajectory T will be described in detail. FIGS. 8 and 9 show changes in the posture of the outer coupling bar 13 when the left leg unit 5 is seen in a side view in a simplified manner. In FIGS. 8 and 9, the front side corresponds to the left side on the paper and the back side corresponds to the right side on the paper. Points p1 to p16 show the rotation axis 14*a* of the pedal 14. Points v1 to v16 show the rotation axis 11*a* of the vertical piece 11. Points h1 to h16 show the rotation axis 12*a* of the horizontal piece 12. These reference numbers correspond to each other in time series. That is, at time 1, the rotation axis 14*a* of the pedal 14 is at the point p1, the rotation axis 11*a* of the vertical piece 11 is at the point v1, the rotation axis 12*a* of the horizontal piece 12 is at the point h1, and the solid line that connects the point p1, the point v1, and the point h1 shows the outer coupling bar 13 at time 1. FIGS. 8 and 9 also show the vertical guide groove 20 and the horizontal guide groove 21, the intersection G thereof, the vertical coil spring 15, and the horizontal coil spring 16.

As shown in FIGS. 8 and 9, when the rotation axis 11*a* of the vertical piece 11 can be slid along the vertical guide groove 20 and the rotation axis 12*a* of the horizontal piece 12 can be slid along the horizontal guide groove 21, the rotation axis 14*a* of the pedal 14 draws the elliptical trajectory T around the intersection G, as shown in the points p1 to p16. For the sake of convenience of the description, it is assumed that the rotation axis 14*a* of the pedal 14 circulates along the elliptical trajectory T in a predetermined direction D shown in FIGS. 8 and 9, that is, in a counterclockwise direction. That is, the rotation axis 14*a* of the pedal 14 moves from the point p1 to the point p2, from the point p2 to the point p3, . . . from the point p15 to the point p16, and from the point p16 to the point p1 in this order.

FIG. 8 shows, of the elliptical trajectories T, a lower trajectory T1, which is a lower-route trajectory, in which the rotation axis 14*a* of the pedal 14 is positioned below a major axis TL of the elliptical trajectory T. FIG. 9 shows, of the elliptical trajectories T, an upper trajectory T2, which is an upper-route trajectory, in which the rotation axis 14*a* of the pedal 14 is positioned above the major axis TL of the elliptical trajectory T.

As shown in FIG. 8, when the rotation axis 14*a* of the pedal 14 moves from the point p1 to the point p4, the rotation axis 11*a* of the vertical piece 11 is raised above the intersection G and the rotation axis 12*a* of the horizontal piece 12 moves backward in a position frontward of the intersection G in such a way that it approaches the intersection G.

When the rotation axis 14*a* of the pedal 14 moves from the point p5 to the point p8, the rotation axis 11*a* of the vertical piece 11 is lowered above the intersection G and the rotation axis 12*a* of the horizontal piece 12 moves backward in a position backward of the intersection G in such a way that it is away from the intersection G.

As shown in FIG. 9, when the rotation axis 14*a* of the pedal 14 moves from the point p9 to the point p12, the rotation axis 11*a* of the vertical piece 11 is lowered below the intersection G, and the rotation axis 12*a* of the horizontal piece 12 moves forward in a position backward of the intersection Gin such a way that it approaches the intersection G.

When the rotation axis 14*a* of the pedal 14 moves from the point p13 to the point p16, the rotation axis 11*a* of the vertical piece 11 is raised below the intersection G, and the rotation axis 12*a* of the horizontal piece 12 moves forward in a position frontward of the intersection Gin such a way that it is away from the intersection G.

Meanwhile, as shown in FIGS. 7 to 9, the vertical coil spring 15 is disposed in the upper end 20*a* of the vertical guide groove 20 and the horizontal coil spring 16 is disposed in the rear end 21*a* of the horizontal guide groove 21.

Therefore, when the vertical piece 11 is raised above the intersection G in such a way that it is away from the intersection G, specifically, when the vertical piece 11 is raised from the point v1 to the point v4 in FIG. 8, the vertical piece 11 compresses the vertical coil spring 15. As the vertical piece 11 compresses the vertical coil spring 15, it receives a downward repulsive force from the vertical coil spring 15. In other words, the vertical coil spring 15 biases the vertical piece 11 toward the intersection G. Therefore, the vertical coil spring 15 applies a load to the movement of the vertical piece 11 that is raised above the intersection G in such a way that it is away from the intersection G. Accordingly, when the pedal 14 moves from the point p1 to the point p4 below the major axis TL of the elliptical trajectory T, the vertical coil spring 15 applies a load to the movement of the pedal 14.

Referring continuously to FIG. 8, when the horizontal piece 12 moves backward in a position backward of the intersection G in such a way that it is away from the intersection G, specifically, when the horizontal piece 12 moves backward from the point h5 to the point h8, the horizontal piece 12 compresses the horizontal coil spring 16. The horizontal piece 12 compresses the horizontal coil spring 16, thereby receiving a forward repulsive force from the horizontal coil spring 16. In other words, the horizontal coil spring 16 biases the horizontal piece 12 toward the intersection G. Therefore, the horizontal coil spring 16 applies a load to the movement of the horizontal piece 12 that moves backward in a position backward of the intersection G in such a way that the horizontal piece 12 is away from the intersection G. Accordingly, when the pedal 14 moves from the point p5 to the point p8 below the major axis TL of the elliptical trajectory T, the horizontal coil spring 16 applies a load to the movement of the pedal 14.

Therefore, when the rotation axis 14*a* of the pedal 14 is positioned below the major axis TL of the elliptical trajectory T and moves from the point p1 to the point p8, the vertical coil spring 15 and the horizontal coil spring 16 apply a load to the movement of the vertical piece 11 and the horizontal piece 12, that is, the movement of the pedal 14. This load condition simulates a load applied when the user kicks his/her leg backward in the stance phase, whereby it can be said that the load condition when the user kicks his/her leg specific to walking is satisfied.

On the other hand, when the vertical piece 11 is lowered below the intersection G in such a way that it is away from the intersection G, specifically, when the vertical piece 11 is lowered from the point v9 to the point v12 in FIG. 9, the vertical piece 11 is able to move with no load.

Likewise, when the horizontal piece 12 moves forward in a position frontward of the intersection Gin such a way that it is away from the intersection G, specifically, when the horizontal piece 12 moves forward from the point h13 to the point h16, the horizontal piece 12 is able to move with no load.

Therefore, when the rotation axis 14*a* of the pedal 14 is positioned above the major axis TL of the elliptical trajectory T and moves from the point p9 to the point p16, the pedal 14 moves with no load. This load condition simulates a load applied when the user swings his/her leg forward in the swing phase, whereby it can be said that the load condition at the time of swinging specific to walking is satisfied.

Figure 10:
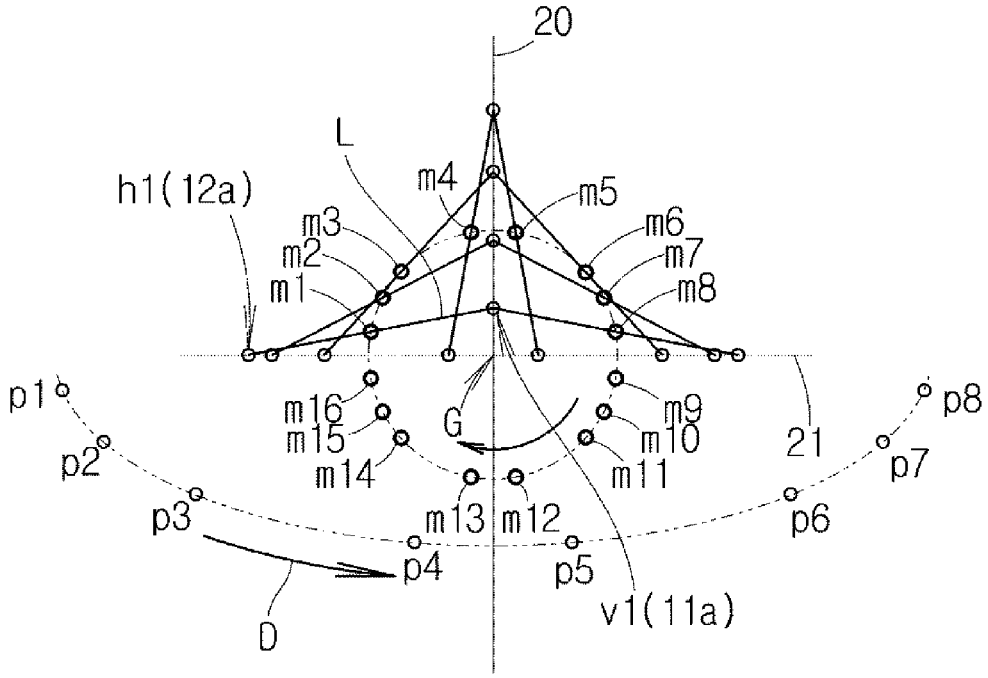
FIG. 10 is a diagram for describing a trajectory of a midpoint (first embodiment)

Referring is now made to FIG. 10. FIG. 10 shows a trajectory of a midpoint m of a line L that connects the rotation axis 11*a* of the vertical piece 11 to the rotation axis 12*a* of the horizontal piece 12. Points m1 to m16 show the midpoint m of the line L. These reference numbers correspond to the points p1 to p16 shown in FIGS. 8 and 9 in time series. It can be seen, from FIG. 10, that the trajectory of the midpoint m of the line L that connects the rotation axis 11*a* of the vertical piece 11 to the rotation axis 12*a* of the horizontal piece 12 is exactly an elliptical trajectory in which the length of the major axis matches the length of the minor axis, that is, a circular trajectory around the intersection G. When the pedal 14 moves from the point p1 to the point p16 in a counterclockwise direction in this order, the midpoint m of the line L moves from the point m1 to the point m16 in a clockwise direction in this order. That is, the position of the pedal 14 and the position of the midpoint m of the line L correspond one-to-one to each other.

Therefore, as shown in FIG. 5, a configuration in which the left-leg-side crank arm 31 is coupled to the center of the left-leg-side inner coupling bar 33 in the longitudinal direction, the right-leg-side crank arm 32 is coupled to the center of the right-leg-side inner coupling bar 34 in the longitudinal direction, and the crank arm body 31*a* of the left-leg-side crank arm 31 and the crank arm body 32*a* of the right-leg-side crank arm 32 are projected in the directions opposite to each other enables the pedal 14 of the left leg unit 5 and the pedal 14 of the right leg unit 6 to be linked to each other in phases opposite to each other, as shown in FIGS. 5 to 7.

Next, reference is made to FIG. 11. FIG. 11 shows a change in the size of the elliptical trajectory T when the place on the outer coupling bar 13 where the pedal 14 is attached is changed. That is, as described above with reference to FIG. 2, the place on the pedal coupling part 13*c* of the outer coupling bar 13 where the pedal 14 is attached can be changed. When the pedal 14 is attached to one of the plurality of fitting parts 22 of the pedal coupling part 13*c* that is the farthest from the horizontal piece coupling part 13*b*, the trajectory of the rotation axis 14*a* of the pedal 14 is a lower trajectory T1, as shown in FIG. 11. If the pedal 14 is attached to one of the plurality of fitting parts 22 of the pedal coupling part 13*c* that is the closest to the horizontal piece coupling part 13*b*, the trajectory of the rotation axis 14*a* of the pedal 14 is a lower trajectory T3 defined by points q1 to q8.

It is assumed that both the lower trajectory T1 and the lower trajectory T3 are parts of the elliptical trajectory and the lengths of the major axes thereof are denoted by a major axis length s1 and a major axis length s2, respectively. It can be seen, from FIG. 11, that, by simply making the place on the pedal coupling part 13*c* of the outer coupling bar 13 where the pedal 14 is attached close to the horizontal piece coupling part 13*b* and away from the horizontal piece coupling part 13*b*, it is possible to simply increase or decrease the size of the elliptical trajectory T, that is, the major axis length. As is clear from FIG. 11, the length of the minor axis of the elliptical trajectory T is also increased or decreased. Therefore, by just changing the place on the pedal coupling part 13*c* of the outer coupling bar 13 where the pedal 14 is attached, it is possible to easily adjust the major axis and the minor axis of the elliptical trajectory T, and even the stride length of the user U during the foot-pedaling exercise in accordance with the physique of the user U, and by increasing or decreasing the major axis and the minor axis of the elliptical trajectory T, the muscle part that is used for the exercise may be changed and the efficiency of the exercise may be improved. Further, by increasing or decreasing the major axis and the minor axis of the elliptical trajectory T, the range in which the joint angles of mainly the hip joint, the knee joint, and the ankle joint increases or decreases during the exercise is expanded or contracted as well, whereby it will be possible to adjust the level of difficulty during the training for recovering the function of each of the joints as well.

Referring once again to FIG. 1, the chair 3 will be explained. The chair 3 includes a sitting part 45 and a chair body 46. The chair body 46 supports the sitting part 45 to be able to carry out a yaw turn, a roll turn, and a pitch turn. As described above, by configuring the sitting part 45 in such a way that it can swing about three axes, the kinematic chain between the lower limb and the trunk can be established during the foot-pedaling exercise, and the trunk muscles such as rectus abdominis, transversus abdominis and erector spinae can be exercised simultaneously while performing the foot-pedaling exercise in a sitting position. And if the exercise of the trunk muscles is achieved as described above, first, it can be expected that the size of the waist will be reduced. Second, it will strengthen the rectus abdominis, transversus abdominis, and erector spinae muscles, whereby it will become easier to maintain a forward-leaning posture of the pelvis, which will also help eliminate hunchbacks and straight necks. In addition, if the kinematic chain between the lower limb and the trunk can be achieved as described above, the pelvis can be moved intensively, which mainly increases the flexibility of the iliopsoas muscle, and chronic low back pain may be reduced.

While the first embodiment of the present disclosure has been described above, the above embodiments have the following features.

That is, the left leg unit 5 includes: the vertical piece 11 (first slider); the horizontal piece 12 (second slider); the vertical guide groove 20 (first guide) that guides the vertical piece 11 in such a way that the vertical piece 11 can be slid linearly; the horizontal guide groove 21 (second guide) that guides the horizontal piece 12 in such a way that the horizontal piece 12 can be slid linearly; the outer coupling bar 13 (first coupling part) to which the vertical piece 11 and the horizontal piece 12 are rotatably coupled, thereby coupling the vertical piece 11 and the horizontal piece 12 to each other; and the pedal 14 rotatably coupled to the outer coupling bar 13. The vertical guide groove 20 and the horizontal guide groove 21 are extended in such a way that they intersect with each other. As shown in FIGS. 8 and 9, the rotation axis 11*a* of the pedal 14 is disposed away from the rotation axis 11*a* of the vertical piece 11 and the rotation axis 12*a* of the horizontal piece 12 and is disposed away from the midpoint m of the line L that connects the rotation axis 11*a* of the vertical piece 11 and the rotation axis 12*a* of the horizontal piece 12, whereby the rotation axis 14*a* of the pedal 14 moves along the elliptical trajectory T. According to the aforementioned configuration, it is possible to move the rotation axis 14*a* of the pedal 14 along the elliptical trajectory T in a simple and compact manner.

Further, the left leg unit 5 further includes the vertical coil spring 15 and the horizontal coil spring 16 as load means for applying a load to the movement of the vertical piece 11 and the horizontal piece 12. According to the aforementioned configuration, the user may mainly exercise muscle parts of his/her lower limb.

Note that one of the vertical coil spring 15 and the horizontal coil spring 16 may be omitted.

Further, as shown in FIGS. 8 and 9, when the pedal 14 is moved in the predetermined direction D and the rotation axis 14*a* of the pedal 14 is positioned below the major axis TL of the elliptical trajectory T, the aforementioned load means applies a load to the movement of the vertical piece 11 and the horizontal piece 12. On the other hand, when the pedal 14 is moved in the predetermined direction D and the rotation axis 14*a* of the pedal 14 is positioned above the major axis TL of the elliptical trajectory T, the load means does not apply a load to the movement of the vertical piece 11 and the horizontal piece 12. According to the aforementioned configuration, load conditions specific to walking, that is, a load is not applied when a user swings his/her leg forward in a swing phase and a load is applied when the user kicks his/her leg backward in a stance phase, may be obtained.

Further, as shown in FIGS. 8 and 9, the aforementioned load means applies a load to the movement of the vertical piece 11 and the horizontal piece 12 in the direction away from the intersection G. According to the aforementioned configuration, the load means may be configured in a simple manner.

Further, as shown in FIGS. 8 and 9, the aforementioned load means is a spring that is provided in the vertical guide groove 20 and the horizontal guide groove 21 and biases the vertical piece 11 and the horizontal piece 12 toward the intersection G. According to the aforementioned configuration, the load means may be configured in a simple manner.

Further, as shown in FIG. 2, the place on the outer coupling bar 13 where the pedal 14 is attached can be changed. According to the aforementioned configuration, as shown in FIG. 11, it is possible to easily increase or decrease the major axis and the minor axis of the elliptical trajectory T. Therefore, it is possible to adjust the major axis and the minor axis of the elliptical trajectory T, and even the stride length of the user U during the foot-pedaling exercise in accordance with the physique of the user U, and by increasing or decreasing the major axis and the minor axis of the elliptical trajectory T, the muscle part that is used for the exercise may be changed and the efficiency of the exercise may be improved. Further, by increasing or decreasing the major axis and the minor axis of the elliptical trajectory T, the range in which the joint angles of mainly the hip joint, the knee joint, and the ankle joint increases or decreases during the exercise is expanded or contracted as well, whereby it is possible to adjust the level of difficulty during the training for recovering the function of each of the joints.

Further, as shown in FIG. 2, the foot-pedaling exercise equipment 2 (pedal support system) includes the left leg unit 5 (pedal support structure for the left leg) and the right leg unit 6 (pedal support structure for the right leg). The left leg unit 5 and the right leg unit 6 are disposed so as to be opposed to each other in the width direction. According to the aforementioned configuration, the right and left legs can be trained simultaneously.

Further, as shown in FIGS. 4 to 6, the foot-pedaling exercise equipment 2 further includes the linking unit 8 (linking mechanism). As shown in FIG. 7, when the linking unit 8 is seen along the rotation axis 14*a* of the pedal 14 of the left leg unit 5, the linking unit 8 links the pedal 14 of the left leg unit 5 to the pedal 14 of the right leg unit 6 in such a way that the rotation axis 14*a* of the pedal 14 of the left leg unit 5 and the rotation axis 14*a* of the pedal 14 of the right leg unit 6 become point symmetrical to each other with respect to the intersection G. According to the aforementioned configuration, it is possible to simulate the movement of the right and left legs during walking more strictly.

Further, as shown in FIGS. 4 to 6, the linking unit 8 includes: the base shaft 30 that is rotatably supported; the left-leg-side crank arm 31 and the right-leg-side crank arm 32 extended from the base shaft 30, the left-leg-side crank arm 31 being extended from the base shaft 30 in a direction opposite to that in which the right-leg-side crank arm 32 is extended; the left-leg-side inner coupling bar 33 (the left-leg-side second coupling part) to which the vertical piece 11 and the horizontal piece 12 of the left leg unit 5 are rotatably coupled, thereby coupling the vertical piece 11 and the horizontal piece 12 of the left leg unit 5 to each other; and the right-leg-side inner coupling bar 34 (the right-leg-side second coupling part) to which the vertical piece 11 and the horizontal piece 12 of the right leg unit 6 are rotatably coupled, thereby coupling the vertical piece 11 and the horizontal piece 12 of the right leg unit 6 to each other. The left-leg-side crank arm 31 is rotatably coupled to the left-leg-side inner coupling bar 33 at the aforementioned midpoint m of the left leg unit 5 in a side view. The right-leg-side crank arm 32 is rotatably coupled to the right-leg-side inner coupling bar 34 at the aforementioned midpoint m of the right leg unit 6 in a side view. According to the aforementioned configuration, the linking unit 8 may be obtained with a simple configuration.

Modified Example

Next, a modified example of the linking unit 8 will be described.

Figure 12:
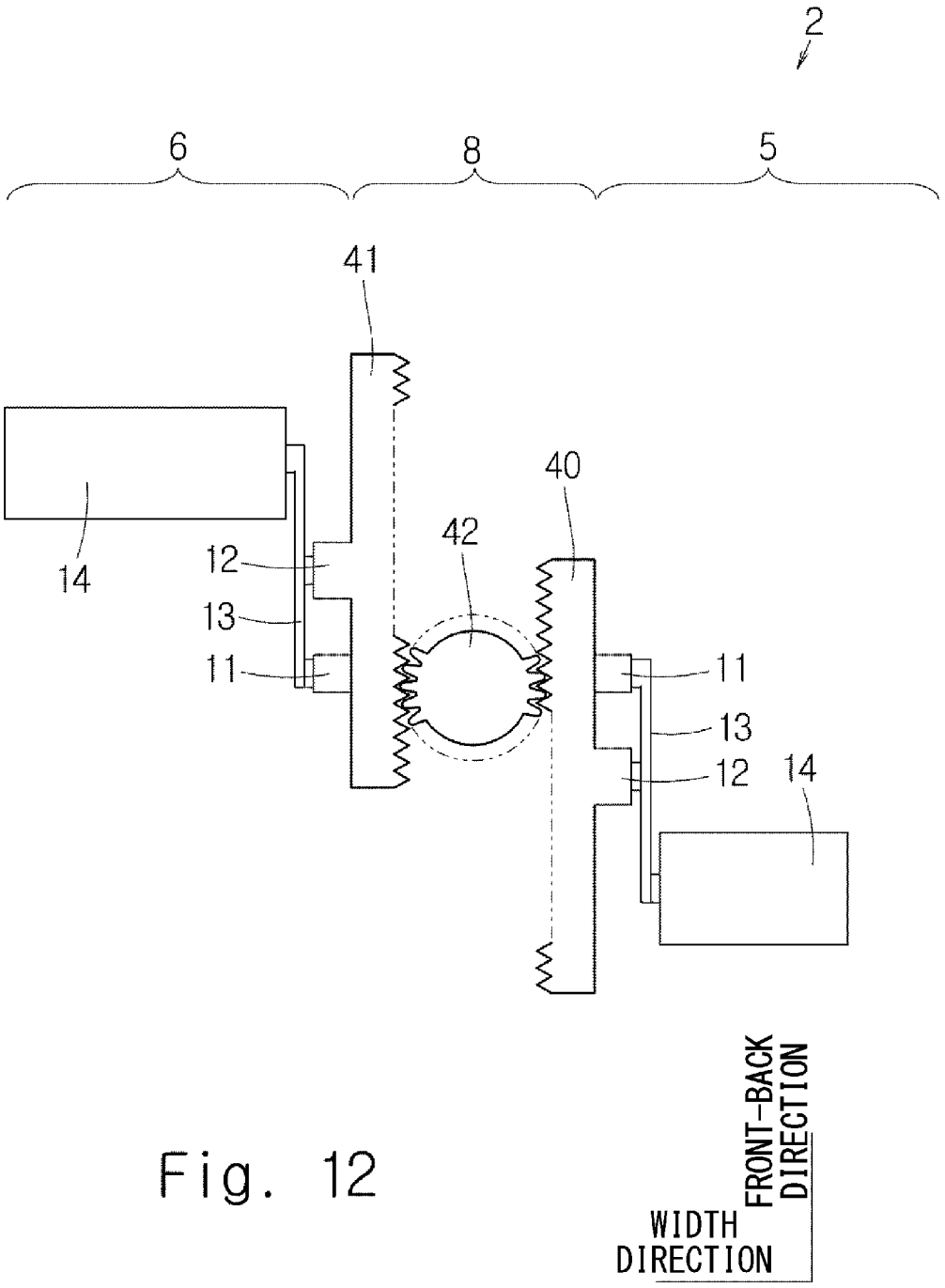
FIG. 12 is a plan view showing another specific example of a linking unit (modified example)

FIG. 12 shows a plan view of a linking unit 8 according to the modified example. In this modified example, the linking unit 8 includes a left-leg-side horizontal rack 40 fixed to a horizontal piece 12 of a left leg unit 5, a right-leg-side horizontal rack 41 fixed to a horizontal piece 12 of a right leg unit 6, and a pinion 42 that meshes with the left-leg-side horizontal rack 40 and the right-leg-side horizontal rack 41 simultaneously. The left-leg-side horizontal rack 40 and the right-leg-side horizontal rack 41 are specific examples of a left-leg-side rack and a right-leg-side rack, respectively.

The left-leg-side horizontal rack 40 is fixed to the horizontal piece 12 of the left leg unit 5 and is extended in the front-back direction. The right-leg-side horizontal rack 41 is fixed to the horizontal piece 12 of the right leg unit 6 and is extended in the front-back direction. In general, the pinion 42 is rotatably supported by the support pillar 35 shown in FIG. 6 (it can freely conduct a yaw turn). When the horizontal piece 12 of the left leg unit 5 moves forward in this configuration, the horizontal piece 12 of the right leg unit 6 moves backward. On the other hand, when the horizontal piece 12 of the left leg unit 5 moves backward, the horizontal piece 12 of the right leg unit 6 moves forward. As described above, the horizontal piece 12 of the left leg unit 5 and the horizontal piece 12 of the right leg unit 6 move forward and backward in an alternate manner. With this configuration as well, as shown in FIG. 7, the pedal 14 of the left leg unit 5 and the pedal 14 of the right leg unit 6 can be linked to each other in such a way that the rotation axis 14*a* of the pedal 14 of the left leg unit 5 and the rotation axis 14*a* of the pedal 14 of the right leg unit 6 become point symmetrical to each other with respect to the intersection G.

To sum up, the linking unit 8 includes the left-leg-side horizontal rack 40 (left-leg-side rack) fixed to the horizontal piece 12 of the left leg unit 5, the right-leg-side horizontal rack 41 (right-leg-side rack) fixed to the horizontal piece 12 of the right leg unit 6, and the pinion 42 that meshes with the left-leg-side horizontal rack 40 and the right-leg-side horizontal rack 41. According to the aforementioned configuration, the linking unit 8 may be obtained with a simple configuration.

Note that the linking unit 8 may include, in place of the aforementioned components, a rack that is fixed to the vertical piece 11 of the left leg unit 5 and is extended in the vertical direction, a rack that is fixed to the vertical piece 11 of the right leg unit 6 and is extended in the vertical direction, and a pinion that meshes with the two racks simultaneously. With this alternative configuration as well, the linking unit 8 may be obtained with a simple configuration.

The aforementioned first embodiment may be changed, for example, as shown below.

That is, while the vertical guide groove 20 is extended along the vertical direction in a side view in the aforementioned first embodiment, as shown in FIG. 7, the vertical guide groove 20 may instead be inclined with respect to the vertical direction.

Likewise, while the horizontal guide groove 21 is extended along the front-back direction in a side view in the aforementioned first embodiment, the horizontal guide groove 21 may instead be inclined with respect to the front-back direction.

Further, while the vertical guide groove 20 and the horizontal guide groove 21 are extended so as to be perpendicular to each other in a side view in the aforementioned first embodiment, the angle between the longitudinal direction of the vertical guide groove 20 and the longitudinal direction of the horizontal guide groove 21 may instead be an acute angle or an obtuse angle.

Further, in the aforementioned first embodiment, the rotation axis 14*a* of the pedal 14 is disposed on an extension of the line that connects the rotation axis 11*a* of the vertical piece 11 and the rotation axis 12*a* of the horizontal piece 12. Alternatively, the rotation axis 14*a* of the pedal 14 may be disposed in a desired position which is neither on the line that connects the rotation axis 11*a* of the vertical piece 11 and the rotation axis 12*a* of the horizontal piece 12 nor on an extension of this line. In this case, the major axis TL of the elliptical trajectory T shown in FIGS. 8 and 9 may be inclined with respect to the front-back direction.

Further, as shown in FIG. 7, in the above first embodiment, the rotation axis 14*a* of the pedal 14 is disposed on an extension of the line that connects the rotation axis 11*a* of the vertical piece 11 and the rotation axis 12*a* of the horizontal piece 12. Alternatively, the rotation axis 14*a* of the pedal 14 may be disposed on the line that connects the rotation axis 11*a* of the vertical piece 11 and the rotation axis 12*a* of the horizontal piece 12.

As described above, it may be decided as desired regarding how to dispose the rotation axis 14*a* of the pedal 14 with respect to the rotation axis 11*a* of the vertical piece 11 and the rotation axis 12*a* of the horizontal piece 12. It should be noted, however, as an exception, when the rotation axis 14*a* of the pedal 14 is made to match the rotation axis 11*a* of the vertical piece 11 or the rotation axis 12*a* of the horizontal piece 12, the rotation axis 14*a* of the pedal 14 linearly moves in a side view, and therefore the pedal 14 cannot be moved along the elliptical trajectory.

Likewise, as an exception, it should be noted that, when the rotation axis 14*a* of the pedal 14 is disposed at the midpoint m of the line L that connects the rotation axis 11*a* of the vertical piece 11 and the rotation axis 12*a* of the horizontal piece 12, the rotation axis 14*a* of the pedal 14 circularly moves along a circular trajectory in a side view, and therefore the pedal 14 cannot be moved along the elliptical trajectory.

Second Embodiment

Hereinafter, with reference to FIGS. 13 to 22, a second embodiment of the present disclosure will be described. Hereinafter, the points of this embodiment that are different from those in the aforementioned first embodiment will be mainly described and the overlapping descriptions will be omitted.

FIGS. 13 to 18 show a foot-pedaling exercise equipment 52. As shown in FIGS. 13 to 18, the foot-pedaling exercise equipment 52 includes a left leg unit 55, a right leg unit 56, a pedestal 57, and a linking unit 58. The left leg unit 55 and the right leg unit 56 are specific examples of a pedal support structure. The left leg unit 55 is one specific example of a pedal support structure for a left leg. The right leg unit 56 is one specific example of a pedal support structure for a right leg. The linking unit 58 is one specific example of a linking mechanism. Note that, in FIGS. 13 and 14, the right leg unit 56 is drawn in a simple manner by an alternate long and two short dashes line. Further, in FIGS. 15 and 16, the right leg unit 56 is not shown.

As shown in FIGS. 13 to 18, the left leg unit 55 includes a guide 60, an upper front oblique piece 61, a horizontal piece 62, an upper rear oblique piece 63, an outer coupling bar 64, a pedal 65, an upper front coil spring 66, a horizontal coil spring 67, and an upper rear coil spring 68.

The upper front oblique piece 61 is one specific example of a first slider. The horizontal piece 62 is one specific example of a second slider. The upper rear oblique piece 63 is one specific example of a third slider. The outer coupling bar 64 is one specific example of a first coupling part. The upper front coil spring 66, the horizontal coil spring 67, and the upper rear coil spring 68 are specific examples of load means. That is, the load means is formed of the upper front coil spring 66, the horizontal coil spring 67, and the upper rear coil spring 68.

Figure 13:
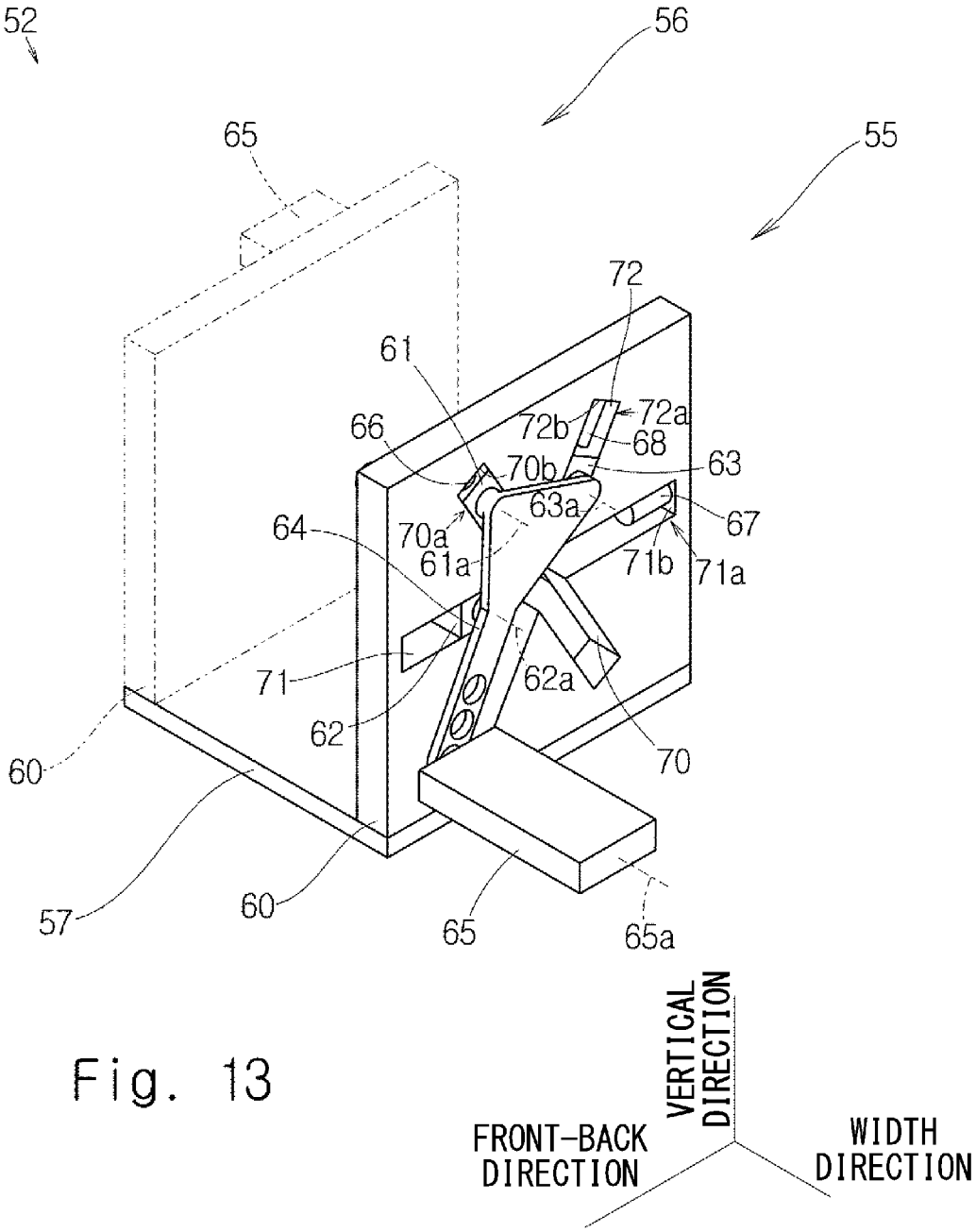
FIG. 13 is a perspective view of a foot-pedaling exercise equipment (second embodiment)
Figure 14:
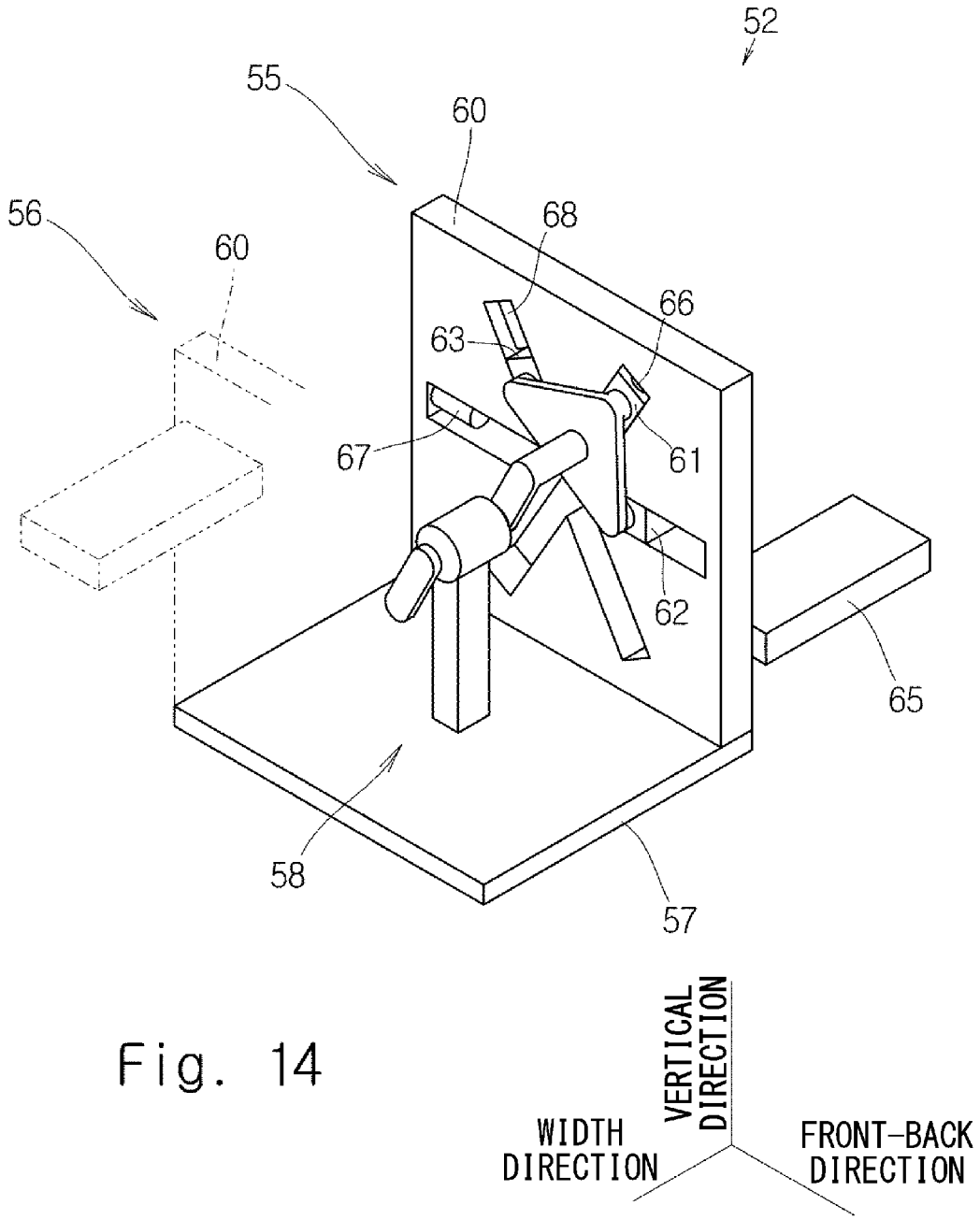
FIG. 14 is a perspective view of the foot-pedaling exercise equipment when it is seen from another angle (second embodiment)
Figure 18:
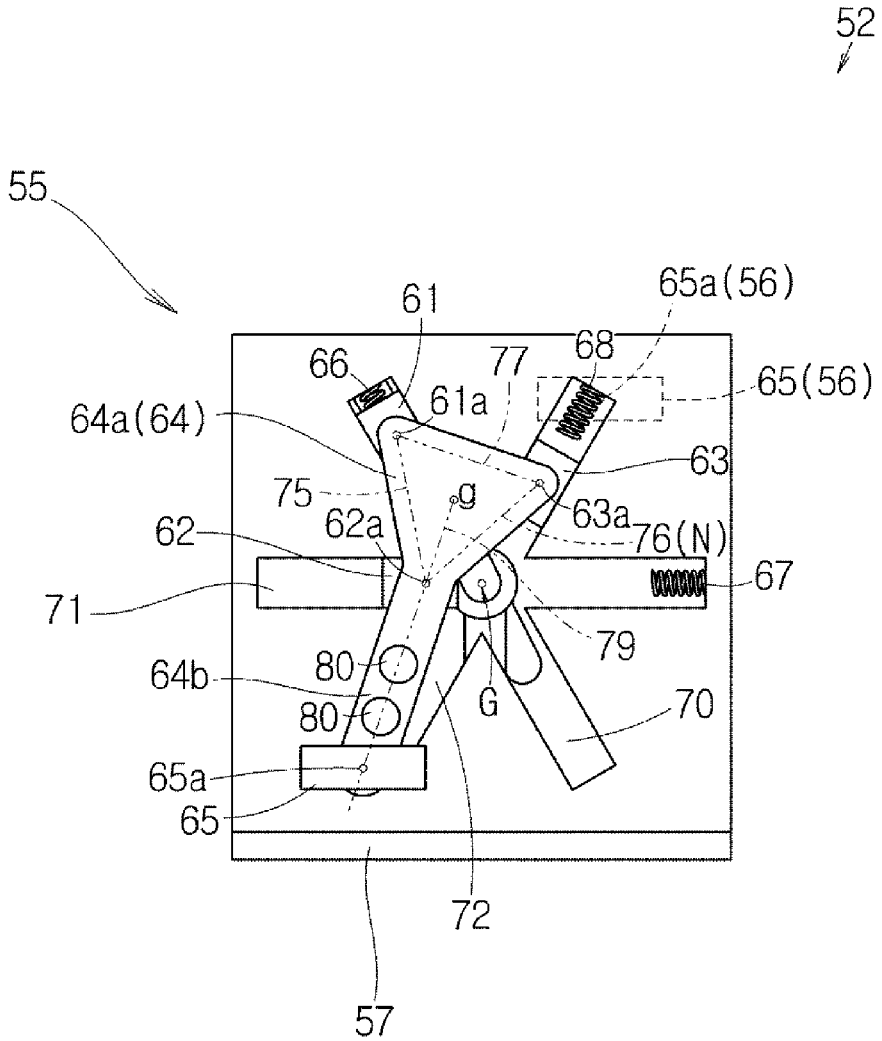
FIG. 18 is a side view of the foot-pedaling exercise equipment (second embodiment)

As shown in FIGS. 13 and 18, in this embodiment, the guide 60 is formed of, for example, a metallic plate body. The thickness direction of the guide 60 is the same as the width direction. An upper front guide groove 70, a horizontal guide groove 71, and an upper rear guide groove 72 are formed in the guide 60. The upper front guide groove 70 is one specific example of a first guide. The horizontal guide groove 71 is one specific example of a second guide. The upper rear guide groove 72 is one specific example of a third guide.

The upper front guide groove 70 is formed to be linearly extended upward and forward in such a way that it is inclined with respect to the front-back direction. The horizontal guide groove 71 is formed to be linearly extended in the front-back direction. The upper rear guide groove 72 is formed to be linearly extended upward and backward in such a way that it is inclined with respect to the front-back direction. When the guide 60 is seen along the width direction, the upper front guide groove 70, the horizontal guide groove 71, and the upper rear guide groove 72 are extended in such a way that they intersect with one another at one point in a side view. Therefore, the upper front guide groove 70, the horizontal guide groove 71, and the upper rear guide groove 72 intersect with one another in such a way that they form a three-way junction in a side view.

The angle between the longitudinal direction of the upper front guide groove 70 and the longitudinal direction of the horizontal guide groove 71 is 60 degrees. The angle between the longitudinal direction of the horizontal guide groove 71 and the longitudinal direction of the upper rear guide groove 72 is 60 degrees. Therefore, the angle between the longitudinal direction of the upper front guide groove 70 and the longitudinal direction of the upper rear guide groove 72 is also 60 degrees.

The upper front guide groove 70 supports the upper front oblique piece 61 in such a way that the upper front oblique piece 61 can be slid linearly along the longitudinal direction of the upper front guide groove 70. The upper front guide groove 70 prohibits the upper front oblique piece 61 from moving in the width direction. The upper front guide groove 70 restrains the upper front oblique piece 61 in the width direction so as to prevent the upper front oblique piece 61 from being fallen off from the upper front guide groove 70 in the width direction. The upper front coil spring 66 is accommodated in an upper end 70*a* of the upper front guide groove 70. The upper front coil spring 66 is accommodated in the upper end 70*a* of the upper front guide groove 70 in a posture in which the pitch direction matches the longitudinal direction of the upper front guide groove 70. The upper end of the upper front coil spring 66 is fixed to an upper partition surface 70*b* that partitions the upper front guide groove 70 in the longitudinal direction of the upper front guide groove 70. In general, the upper front coil spring 66 is a compression coil spring.

The horizontal guide groove 71 supports the horizontal piece 62 in such a way that the horizontal piece 62 can be slid linearly along the longitudinal direction of the horizontal guide groove 71. The horizontal guide groove 71 prohibits the horizontal piece 62 from moving in the vertical direction and the width direction. The horizontal guide groove 71 restrains the horizontal piece 62 in the width direction so as to prevent the horizontal piece 62 from being fallen off from the horizontal guide groove 71 in the width direction. The horizontal coil spring 67 is accommodated in a rear end 71*a* of the horizontal guide groove 71. The horizontal coil spring 67 is accommodated in the rear end 71*a* of the horizontal guide groove 71 in a posture in which the pitch direction matches the longitudinal direction of the horizontal guide groove 71. The rear end of the horizontal coil spring 67 is fixed to the back partition surface 71*b* that partitions the horizontal guide groove 71 in the front-back direction. The horizontal coil spring 67 is generally a compression coil spring.

The upper rear guide groove 72 supports the upper rear oblique piece 63 in such a way that the upper rear oblique piece 63 can be slid linearly along the longitudinal direction of the upper rear guide groove 72. The upper rear guide groove 72 prohibits the upper rear oblique piece 63 from moving in the width direction. The upper rear guide groove 72 restrains the upper rear oblique piece 63 in the width direction so as to prevent the upper rear oblique piece 63 from being fallen off from the upper rear guide groove 72 in the width direction. The upper rear coil spring 68 is accommodated in an upper end 72*a* of the upper rear guide groove 72. The upper rear coil spring 68 is accommodated in the upper end 72*a* of the upper rear guide groove 72 in a posture in which the pitch direction matches the longitudinal direction of the upper rear guide groove 72. The upper end of the upper rear coil spring 68 is fixed to an upper partition surface 72*b* that partitions the upper rear guide groove 72 in the longitudinal direction of the upper rear guide groove 72. The upper rear coil spring 68 is generally a compression coil spring.

Since the upper front guide groove 70, the horizontal guide groove 71, and the upper rear guide groove 72 intersect with one another at one point, the upper front oblique piece 61 that slides in the upper front guide groove 70 locally passes through the inner space of the horizontal guide groove 71 and the inner space of the upper rear guide groove 72. Likewise, the horizontal piece 62 that slides in the horizontal guide groove 71 locally passes through the inner space of the upper front guide groove 70 and the inner space of the upper rear guide groove 72. Likewise, the upper rear oblique piece 63 that slides in the upper rear guide groove 72 locally passes through the inner space of the upper front guide groove 70 and the inner space of the horizontal guide groove 71.

The outer coupling bar 64 couples the upper front oblique piece 61, the horizontal piece 62, and the upper rear oblique piece 63 to one another. The outer coupling bar 64 is disposed outward of the guide 60 in the width direction. The expression "outward in the width direction" that is used to explain the left leg unit 55 means a width direction that is away from the right leg unit 56. The upper front oblique piece 61, the horizontal piece 62, the upper rear oblique piece 63, and the pedal 65 are rotatably (they can freely conduct a pitch turn) coupled to the outer coupling bar 64. Therefore, the upper front oblique piece 61 includes a rotation axis 61*a* with respect to the outer coupling bar 64. The rotation axis 61*a* is extended in the width direction. The horizontal piece 62 includes a rotation axis 62*a* with respect to the outer coupling bar 64. The rotation axis 62*a* is extended in the width direction. The upper rear oblique piece 63 includes a rotation axis 63*a* with respect to the outer coupling bar 64. The rotation axis 63*a* is extended in the width direction. The pedal 65 includes a rotation axis 65*a* with respect to the outer coupling bar 64. The rotation axis 65*a* is extended in the width direction.

As shown in FIG. 18, the outer coupling bar 64 includes a bar body 64*a* having a substantially equilateral triangle shape that couples the upper front oblique piece 61, the horizontal piece 62, and the upper rear oblique piece 63 to one another, and a pedal coupling part 64*b* to which the pedal 65 is rotatably coupled.

The bar body 64*a* couples the upper front oblique piece 61, the horizontal piece 62, and the upper rear oblique piece 63 to one another in such a way that the rotation axis 61*a* of the upper front oblique piece 61, the rotation axis 62*a* of the horizontal piece 62, and the rotation axis 63*a* of the upper rear oblique piece 63 are positioned at apices of an equilateral triangle in a side view. In other words, a line 75 that connects the rotation axis 61*a* to the rotation axis 62*a*, a line 76 that connects the rotation axis 62*a* to the rotation axis 63*a*, and a line 77 that connects the rotation axis 63*a* to the rotation axis 61*a* form an equilateral triangle N. Then, the pedal coupling part 64*b* is extended along an extension of a line 79 that connects the center of gravity g of the equilateral triangle N to the rotation axis 62*a*. The rotation axis 65*a* of the pedal 65 is disposed on an extension of the line 79 that connects the center of gravity g of the equilateral triangle N to the rotation axis 62*a*. The rotation axis 65*a* is positioned on the side opposite to the center of gravity g with the rotation axis 62*a* therebetween. That is, the rotation axis 62*a* is positioned between the rotation axis 65*a* and the center of gravity g.

A plurality of fitting parts 80 to or from which the pedal 65 can be attached or detached are formed in the pedal coupling part 64*b*. The plurality of fitting parts 80 are formed in a line along the longitudinal direction of the pedal coupling part 64*b*. Therefore, the place on the outer coupling bar 64 where the pedal 65 is attached can be changed. When, for example, the pedal 65 is attached to one of the plurality of fitting parts 80 that is the closest to the rotation axis 62*a* of the horizontal piece 62, the distance between the rotation axis 65*a* of the pedal 65 and the rotation axis 62*a* of the horizontal piece 62 can be made the shortest. On the other hand, when the pedal 65 is attached to one of the plurality of fitting parts 80 that is the farthest from the rotation axis 62*a* of the horizontal piece 62, the distance between the rotation axis 65*a* of the pedal 65 and the rotation axis 62*a* of the horizontal piece 62 can be made the largest.

Referring continuously to FIG. 18, even when the pedal 65 is attached to any one of the plurality of fitting parts 80, the rotation axis 65*a* of the pedal 65 is disposed away from the rotation axis 61*a* of the upper front oblique piece 61, the rotation axis 62*a* of the horizontal piece 62, and the rotation axis 63*a* of the upper rear oblique piece 63. Furthermore, the rotation axis 65*a* of the pedal 65 is disposed away from the center of gravity g in a side view. Therefore, while the details will be described later, the trajectory along which the rotation axis 65*a* of the pedal 65 moves is an elliptical trajectory in which the front-back direction corresponds to a major axis and the vertical direction corresponds to a minor axis in a side view.

Figure 17:
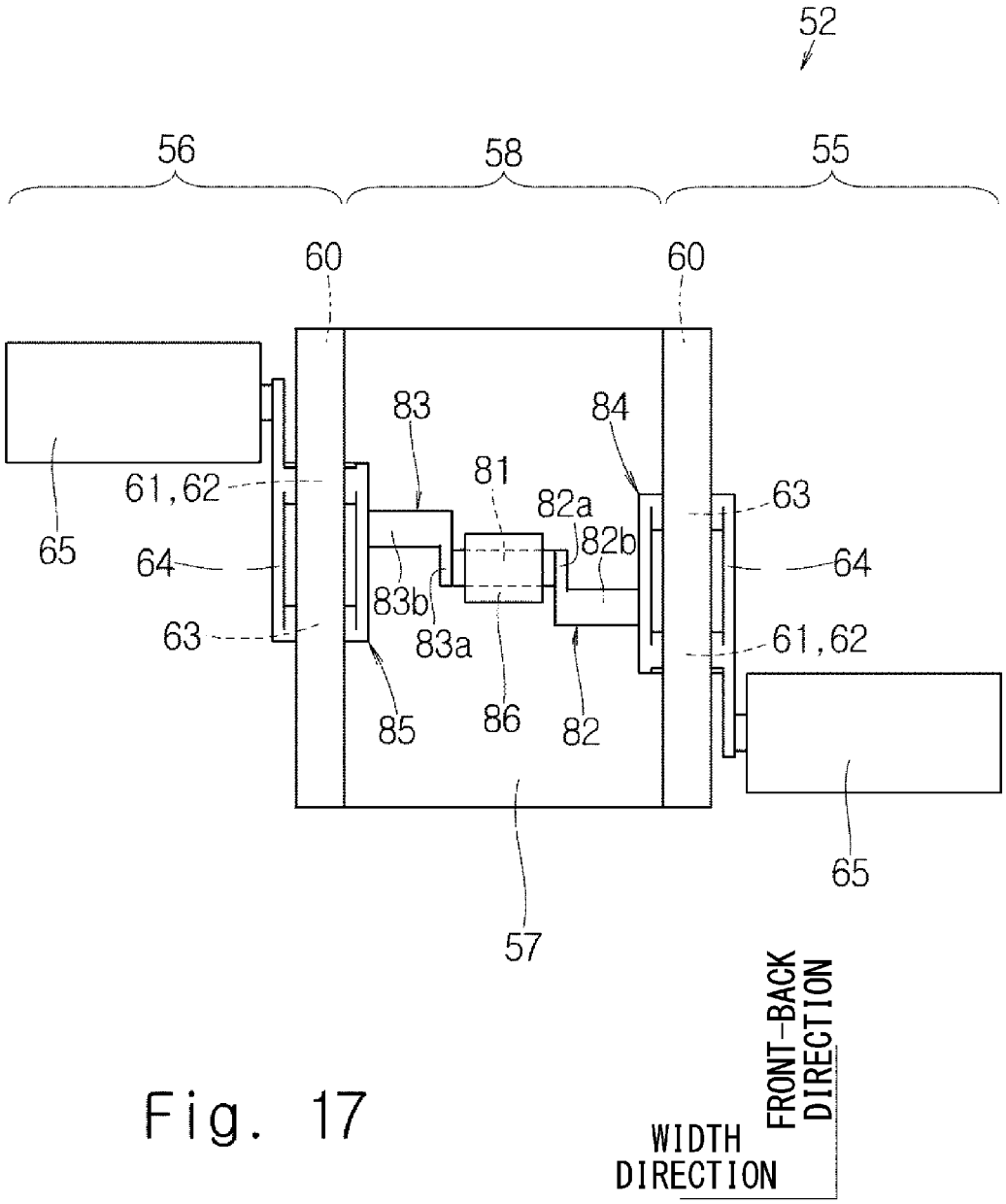
FIG. 17 is a plan view of the foot-pedaling exercise equipment (second embodiment)

As shown in FIG. 17, like the left leg unit 55, the right leg unit 56 include a guide 60, an upper front oblique piece 61, a horizontal piece 62, an upper rear oblique piece 63, an outer coupling bar 64, a pedal 65, an upper front coil spring 66, a horizontal coil spring 67, and an upper rear coil spring 68. Since the configuration of the right leg unit 56 is symmetrical to the configuration of the left leg unit 55 described above, the descriptions thereof will be omitted.

Referring once again to FIG. 13, the pedestal 57 couples the left leg unit 55 to the right leg unit 56 that are opposed to each other in the width direction. Specifically, the pedestal 57 is formed of a metallic plate body that couples the guide 60 of the left leg unit 55 and the guide 60 of the right leg unit 56 to each other.

As shown in FIGS. 15 to 17, the linking unit 58 links the left-leg foot-pedaling exercise in the left leg unit 55 and the right-leg foot-pedaling exercise in the right leg unit 56 to each other. That is, the linking unit 58 links the pedal 65 of the left leg unit 55 and the pedal 65 of the right leg unit 56 to each other. The linking unit 58 is disposed between the left leg unit 55 and the right leg unit 56 in the width direction.

As shown in FIGS. 16 and 17, the linking unit 58 includes a base shaft 81, a left-leg-side crank arm 82, a right-leg-side crank arm 83, a left-leg-side inner coupling part 84, and a right-leg-side inner coupling part 85.

The base shaft 81, which is a shaft that is extended in the width direction, is rotatably supported by a support pillar 86 that is projected upward from the pedestal 57.

The left-leg-side crank arm 82 and the right-leg-side crank arm 83 are extended in the directions opposite to each other from the base shaft 81.

Specifically, the left-leg-side crank arm 82 includes a crank arm body 82*a* and a horizontal extension part 82*b*. The crank arm body 82*a* is extended from an end part of the base shaft 81 on the side of the left leg unit 55. The crank arm body 82*a* is extended in the direction perpendicular to the longitudinal direction of the base shaft 81. The horizontal extension part 82*b* is extended outward in the width direction from a tip of the crank arm body 82*a*.

Likewise, the right-leg-side crank arm 83 includes a crank arm body 83*a* and a horizontal extension part 83*b*. The crank arm body 83*a* is extended from an end part of the base shaft 81 on the side of the right leg unit 56. The crank arm body 83*a* is extended in the direction perpendicular to the longitudinal direction of the base shaft 81. The horizontal extension part 83*b* is extended outward in the width direction from a tip of the crank arm body 82*a*.

Then, as shown in FIG. 16, the crank arm body 82*a* of the left-leg-side crank arm 82 and the crank arm body 83*a* of the right-leg-side crank arm 83 are extended in the longitudinal direction of the base shaft 81, more specifically, in the direction that is perpendicular to the width direction and in directions opposite to each other.

Like the outer coupling bar 64 of the left leg unit 55, the left-leg-side inner coupling part 84 couples the upper front oblique piece 61, the horizontal piece 62, and the upper rear oblique piece 63 of the left leg unit 55 to one another. As shown in FIG. 17, the left-leg-side inner coupling part 84 is disposed inward of the guide 60 of the left leg unit 55 in the width direction. Therefore, the guide 60 of the left leg unit 55 is positioned between the outer coupling bar 64 of the left leg unit 55 and the left-leg-side inner coupling part 84 in the width direction. The upper front oblique piece 61, the horizontal piece 62, and the upper rear oblique piece 63 of the left leg unit 55 are rotatably (they can freely conduct a pitch turn) coupled to the left-leg-side inner coupling part 84.

Like the outer coupling bar 64 of the right leg unit 56, the right-leg-side inner coupling part 85 couples the upper front oblique piece 61, the horizontal piece 62, and the upper rear oblique piece 63 of the right leg unit 56 to one another. The right-leg-side inner coupling part 85 is disposed inward of the guide 60 of the right leg unit 56 in the width direction. Therefore, the guide 60 of the right leg unit 56 is positioned between the outer coupling bar 64 of the right leg unit 56 and the right-leg-side inner coupling part 85 in the width direction. The upper front oblique piece 61, the horizontal piece 62, and the upper rear oblique piece 63 of the right leg unit 56 are rotatably (they can freely conduct a pitch turn) coupled to the right-leg-side inner coupling part 85.

As shown in FIG. 16, the horizontal extension part 82*b* of the left-leg-side crank arm 82 is rotatably (it can freely conduct a pitch turn) coupled to the left-leg-side inner coupling part 84 at the center of gravity g of the equilateral triangle N that connects the rotation axis 61*a* of the upper front oblique piece 61, the rotation axis 62*a* of the horizontal piece 62, and the rotation axis 63*a* of the upper rear oblique piece 63 of the left leg unit 55.

Likewise, the horizontal extension part 83*b* of the right-leg-side crank arm 83 is rotatably (it can freely conduct a pitch turn) coupled to the right-leg-side inner coupling part 85 at the center of gravity g of the equilateral triangle N that connects the rotation axis 61*a* of the upper front oblique piece 61, the rotation axis 62*a* of the horizontal piece 62, and the rotation axis 63*a* of the upper rear oblique piece 63 of the right leg unit 56.

By coupling the left leg unit 55 to the right leg unit 56 via the aforementioned linking unit 58, as shown in FIG. 18, the pedal 65 of the left leg unit 55 and the pedal 65 of the right leg unit 56 are linked to each other in phases opposite to each other. That is, as shown in FIG. 18, in a side view, a positional relation in which the rotation axis 65*a* of the pedal 65 of the left leg unit 55 and the rotation axis 65*a* of the pedal 65 of the right leg unit 56 become point symmetrical to each other with respect to the intersection G of the upper front guide groove 70, the horizontal guide groove 71, and the upper rear guide groove 72 of the left leg unit 55 is always established during the foot-pedaling exercise.

Figure 20:
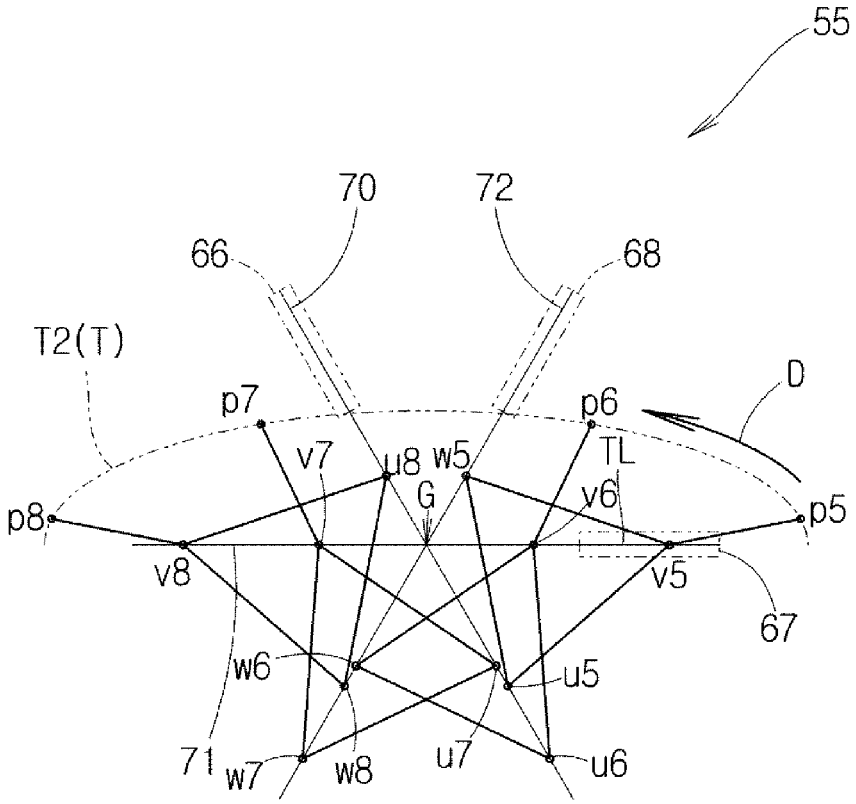
FIG. 20 is a diagram for describing an upper-route trajectory of the pedal (second embodiment)

Referring next to FIGS. 19 and 20, a mechanism that the left leg unit 55 achieves the elliptical trajectory T will be described in detail. FIGS. 19 and 20 draw changes in the posture of the outer coupling bar 64 in a simplified manner when the left leg unit 55 is seen in a side view. In FIGS. 19 and 20, the front side corresponds to the left side on the paper and the back side corresponds to the right side on the paper. Points p1 to p8 show the rotation axis 65*a* of the pedal 65. Points u1 to u8 show the rotation axis 61*a* of the upper front oblique piece 61. Points v1 to v8 show the rotation axis 62*a* of the horizontal piece 62. Points w1 to w8 show the rotation axis 63*a* of the upper rear oblique piece 63. These reference numbers correspond to each other in time series. That is, at time 1, the rotation axis 65*a* of the pedal 65 is at the point p1, the rotation axis 61*a* of the upper front oblique piece 61 is at the point u1, the rotation axis 62*a* of the horizontal piece 62 is at the point v1, the rotation axis 63*a* of the upper rear oblique piece 63 is at the point w1, and a solid line that connects the point u1, the point v1, and the point w1 to one another and a solid line that connects the point p1 to the point v1 show the outer coupling bar 64 at time 1. FIGS. 19 and 20 also show the upper front guide groove 70, the horizontal guide groove 71, the upper rear guide groove 72, the intersection G thereof, the upper front coil spring 66, the horizontal coil spring 67, and the upper rear coil spring 68.

As shown in FIGS. 19 and 20, when the rotation axis 61*a* of the upper front oblique piece 61 can be slid along the upper front guide groove 70, the rotation axis 62*a* of the horizontal piece 62 can be slid along the horizontal guide groove 71, and the rotation axis 63*a* of the upper rear oblique piece 63 can be slid along the upper rear guide groove 72, the rotation axis 65*a* of the pedal 65 draws an elliptical trajectory T around the intersection G, as shown in the points p1 to p8. For the sake of convenience of the description, the rotation axis 65*a* of the pedal 65 circulates along the elliptical trajectory T in the predetermined direction D shown in FIGS. 19 and 20, that is, in a counterclockwise direction. That is, the rotation axis 65*a* of the pedal 65 moves from the point p1 to the point p2, from the point p2 to the point p3, . . . from the point p7 to the point p8, from the point p8 to the point p1 in this order.

FIG. 19 shows, of the elliptical trajectories T, a lower trajectory T1, which is a lower-route trajectory in which the rotation axis 65*a* of the pedal 65 is positioned below a major axis TL of the elliptical trajectory T. FIG. 20 shows, of the elliptical trajectories T, an upper trajectory T2, which is an upper-route trajectory in which the rotation axis 65*a* of the pedal 65 is positioned above the major axis TL of the elliptical trajectory T.

As shown in FIG. 19, when the rotation axis 65*a* of the pedal 65 moves from the point p1 to the point p2, the rotation axis 61*a* of the upper front oblique piece 61 is raised above the intersection G in such a way that it is away from the intersection G. The rotation axis 62*a* of the horizontal piece 62 moves backward in a position frontward of the intersection G in such a way that it approaches the intersection G. The rotation axis 63*a* of the upper rear oblique piece 63 is raised from the bottom to the top of the intersection G in such a way that it crosses over the intersection G.

When the rotation axis 65*a* of the pedal 65 moves from the point p2 to the point p3, the rotation axis 61*a* of the upper front oblique piece 61 is lowered above the intersection G in such a way that it approaches the intersection G. The rotation axis 62*a* of the horizontal piece 62 moves backward from the front side to the back side of the intersection G in such a way that it crosses over the intersection G. The rotation axis 63*a* of the upper rear oblique piece 63 is raised above the intersection G in such a way that it is away from the intersection G.

When the rotation axis 65*a* of the pedal 65 moves from the point p3 to the point p4, the rotation axis 61*a* of the upper front oblique piece 61 is lowered from the top to the bottom of the intersection G in such a way that it crosses over the intersection G. The rotation axis 62*a* of the horizontal piece 62 moves backward on the back side of the intersection G in such a way that it is away from the intersection G. The rotation axis 63*a* of the upper rear oblique piece 63 is lowered above the intersection G in such a way that it approaches the intersection G.

As shown in FIG. 20, when the rotation axis 65*a* of the pedal 65 moves from the point p5 to the point p6, the rotation axis 61*a* of the upper front oblique piece 61 is lowered below the intersection G in such a way that it is away from the intersection G. The rotation axis 62*a* of the horizontal piece 62 moves forward in a position backward of the intersection G in such a way that it approaches the intersection G. The rotation axis 63*a* of the upper rear oblique piece 63 is lowered from the top to the bottom of the intersection Gin such a way that it crosses over the intersection G.

When the rotation axis 65*a* of the pedal 65 moves from the point p6 to the point p7, the rotation axis 61*a* of the upper front oblique piece 61 is raised below the intersection G in such a way that it approaches the intersection G. The rotation axis 62*a* of the horizontal piece 62 moves forward from the back side to the front side of the intersection G in such a way that it crosses over the intersection G. The rotation axis 63*a* of the upper rear oblique piece 63 is lowered below the intersection G in such a way that it is away from the intersection G.

When the rotation axis 65*a* of the pedal 65 moves from the point p7 to the point p8, the rotation axis 61*a* of the upper front oblique piece 61 is raised from the bottom to the top of the intersection G in such a way that it crosses over the intersection G. The rotation axis 62*a* of the horizontal piece 62 moves forward in a position frontward of the intersection Gin such a way that it is away from the intersection G. The rotation axis 63*a* of the upper rear oblique piece 63 is raised below the intersection G in such a way that it approaches the intersection G.

Meanwhile, as shown in FIGS. 18 to 20, the upper front coil spring 66 is disposed in the upper end 70*a* of the upper front guide groove 70, the horizontal coil spring 67 is disposed in the rear end 71*a* of the horizontal guide groove 71, and the upper rear coil spring 68 is disposed in the upper end 72*a* of the upper rear guide groove 72.

Therefore, when the upper front oblique piece 61 is raised above the intersection G in such a way that it is away from the intersection G, specifically, when the upper front oblique piece 61 is raised from the point u1 to the point u2 in FIG. 19, the upper front oblique piece 61 compresses the upper front coil spring 66. The upper front oblique piece 61 receives a downward repulsive force from the upper front coil spring 66 by compressing the upper front coil spring 66. In other words, the upper front coil spring 66 biases the upper front oblique piece 61 toward the intersection G. Therefore, the upper front coil spring 66 applies a load to the movement of the upper front oblique piece 61 that is raised above the intersection G in such a way that it is away from the intersection G. Accordingly, when the pedal 65 moves from the point p1 to the point p2 below the major axis TL of the elliptical trajectory T, the upper front coil spring 66 applies a load to the movement of the pedal 65.

Further, when the upper rear oblique piece 63 is raised above the intersection G in such a way that it is away from the intersection G, specifically, when the upper rear oblique piece 63 is raised from the point w2 to the point w3, the upper rear oblique piece 63 compresses the upper rear coil spring 68. The upper rear oblique piece 63 receives a downward repulsive force from the upper rear coil spring 68 by compressing the upper rear coil spring 68. In other words, the upper rear coil spring 68 biases the upper rear oblique piece 63 toward the intersection G. Therefore, the upper rear coil spring 68 applies a load to the movement of the upper rear oblique piece 63 that is raised above the intersection G in such a way that it is away from the intersection G. Accordingly, when the pedal 65 moves from the point p2 to the point p3 below the major axis TL of the elliptical trajectory T, the upper rear coil spring 68 applies a load to the movement of the pedal 65.

Further, when the horizontal piece 62 moves backward in a position backward of the intersection Gin such a way that it is away from the intersection G, specifically, when the horizontal piece 62 moves backward from the point v3 to the point v4, the horizontal piece 62 compresses the horizontal coil spring 67. The horizontal piece 62 receives a forward repulsive force from the horizontal coil spring 67 by compressing the horizontal coil spring 67. In other words, the horizontal coil spring 67 biases the horizontal piece 62 toward the intersection G. Therefore, the horizontal coil spring 67 applies a load to the movement of the horizontal piece 62 that moves backward in a position backward of the intersection G in such a way that it is away from the intersection G. Accordingly, when the pedal 65 moves from the point p3 to the point p4 below the major axis TL of the elliptical trajectory T, the horizontal coil spring 67 applies a load to the movement of the pedal 65.

Therefore, when the rotation axis 65*a* of the pedal 65 is located below the major axis TL of the elliptical trajectory T and moves from the point p1 to the point p4, the upper front coil spring 66, the horizontal coil spring 67, and the upper rear coil spring 68 apply a load to the movement of the upper front oblique piece 61, the horizontal piece 62, and the upper rear oblique piece 63, that is, the movement of the pedal 65. This load condition simulates a load applied when the user kicks his/her leg backward in the stance phase, whereby it can be said that the load condition when the user kicks his/her leg specific to walking is satisfied.

On the other hand, when the upper front oblique piece 61 is lowered below the intersection G in such a way that it is away from the intersection G in FIG. 20, specifically, when the upper front oblique piece 61 is lowered from the point u5 to the point u6, the upper front oblique piece 61 can move with no load.

Likewise, when the upper rear oblique piece 63 is lowered below the intersection G in such a way that it is away from the intersection G, specifically, when the upper rear oblique piece 63 is lowered from the point w6 to the point w7, the upper rear oblique piece 63 can move with no load.

Likewise, when the horizontal piece 62 moves forward in a position frontward of the intersection Gin such a way that it is away from the intersection G, specifically, when the horizontal piece 62 moves forward from the point v7 to the point v8, the horizontal piece 62 can move with no load.

Therefore, when the rotation axis 65*a* of the pedal 65 is positioned above the major axis TL of the elliptical trajectory T and moves from the point p5 to the point p8, the upper front coil spring 66, the horizontal coil spring 67, and the upper rear coil spring 68 do not apply a load to the movement of the upper front oblique piece 61, the horizontal piece 62, and the upper rear oblique piece 63, that is, the movement of the pedal 65. In other words, when the rotation axis 65*a* of the pedal 65 is positioned above the major axis TL of the elliptical trajectory T and moves from the point p5 to the point p8, the pedal 65 moves with no load. This load condition simulates a load applied when the user swings his/her leg forward in the swing phase, whereby it can be said that the load condition at the time of swinging specific to walking is satisfied.

Next, reference is made to FIG. 21. FIG. 21 shows a trajectory of the center of gravity g of the equilateral triangle N that connects the rotation axis 61*a* of the upper front oblique piece 61, the rotation axis 62*a* of the horizontal piece 62, and the rotation axis 63*a* of the upper rear oblique piece 63. Points g1 to g8 are the points that express the center of gravity g of the equilateral triangle N aligned in time series. These reference numbers correspond to the points p1 to p8 shown in FIGS. 19 and 20 in time series. It can be seen, from FIG. 21, that the trajectory of the center of gravity g of the equilateral triangle N is exactly an elliptical trajectory in which the length of the major axis matches the length of the minor axis, that is, a circular trajectory around the intersection G. Then, when the pedal 65 moves from the point p1 to the point p8 in a counterclockwise direction in this order, the center of gravity g of the equilateral triangle N moves from the point g1 to the point g8 in a clockwise direction in this order. That is, the position of the pedal 65 and the position of the center of gravity g of the equilateral triangle N correspond one-to-one to each other.

Therefore, as shown in FIG. 16, the configuration in which the left-leg-side crank arm 82 is coupled to the center of gravity g of the equilateral triangle N in the left-leg-side inner coupling part 84, the right-leg-side crank arm 83 is coupled to the center of gravity g of the equilateral triangle N in the right-leg-side inner coupling part 85, and the crank arm body 82*a* of the left-leg-side crank arm 82 and the crank arm body 83*a* of the right-leg-side crank arm 83 are projected in the directions opposite to each other enables the pedal 65 of the left leg unit 55 and the pedal 65 of the right leg unit 56 to link to each other in the phases opposite to each other, as shown in FIGS. 17 and 18.

Figure 22:
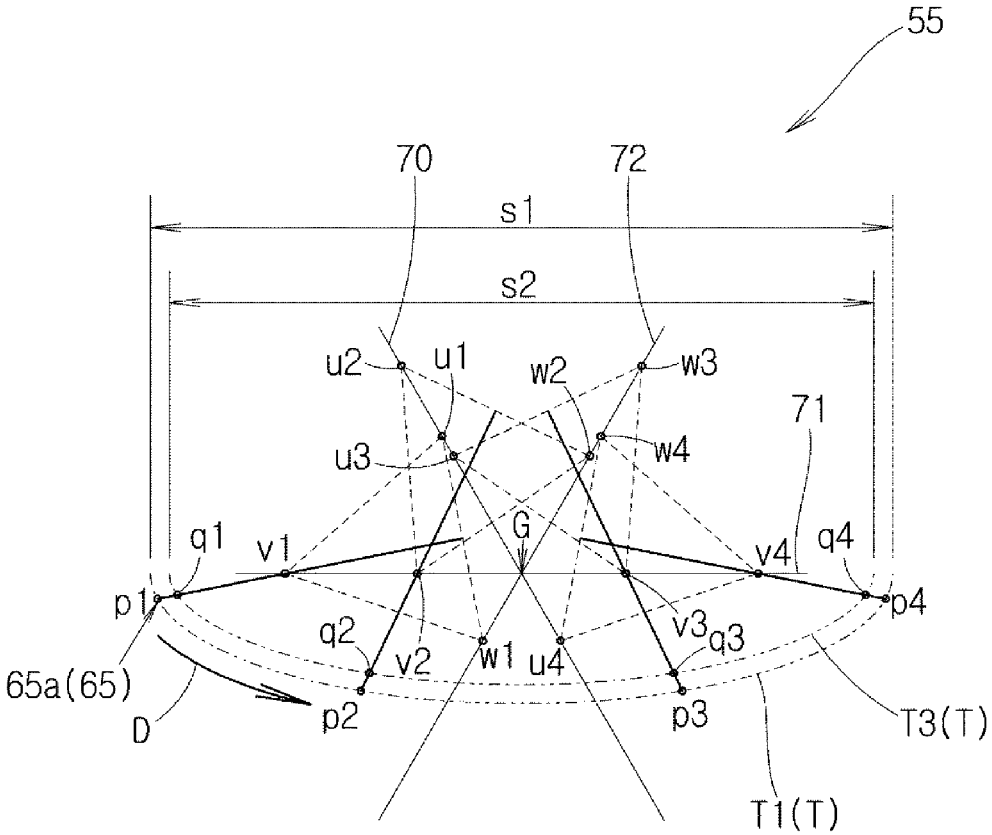
FIG. 22 is a diagram showing a relation between a position where a pedal is attached and the size of an elliptical trajectory (second embodiment)

Next, reference is made to FIG. 22. FIG. 22 shows a change in the size of the elliptical trajectory T when the place on the outer coupling bar 64 where the pedal 65 is attached is changed. That is, as described above with reference to FIG. 18, the place on the pedal coupling part 64*b* of the outer coupling bar 64 where the pedal 65 is attached can be changed. When the pedal 65 is attached to one of the plurality of fitting parts 80 of the pedal coupling part 64*b* that is the farthest from the rotation axis 62*a* of the horizontal piece 62, as shown in FIG. 22, the trajectory of the rotation axis 65*a* of the pedal 65 is a lower trajectory T1. If the pedal 65 is attached to one of the plurality of fitting parts 80 of the pedal coupling part 64*b* that is the closest to the rotation axis 62*a* of the horizontal piece 62, the trajectory of the rotation axis 65*a* of the pedal 65 is a lower trajectory T3 defined by points q1 to q4.

It is assumed that both the lower trajectory T1 and the lower trajectory T3 are parts of the elliptical trajectory and the lengths of the major axes thereof are referred to as a major axis length s1 and a major axis length s2. It can be seen, from FIG. 22, that, by simply making the place on the pedal coupling part 64*b* of the outer coupling bar 64 where the pedal 65 is attached closer to the rotation axis 62*a* of the horizontal piece 62 or away from the rotation axis 62*a* of the horizontal piece 62, it is possible to easily increase or decrease the size of the elliptical trajectory T, that is, the major axis length. As is clear from FIG. 22, the length of the minor axis of the elliptical trajectory T is also increased or decreased. Therefore, by simply changing the place on the pedal coupling part 64*b* of the outer coupling bar 64 where the pedal 65 is attached, it is possible to easily adjust the major axis and the minor axis of the elliptical trajectory T, and even the stride length of the user U during the foot-pedaling exercise in accordance with the physique of the user U, and by increasing or decreasing the major axis and the minor axis of the elliptical trajectory T, the muscle part that is used for exercise can he changed and the exercise efficiency can be improved. Further, by increasing or decreasing the major axis and the minor axis of the elliptical trajectory T, the range in which the joint angles of mainly the hip joint, the knee joint, and the ankle joint increases or decreases during the exercise is expanded or contracted as well, whereby it will be possible to adjust the level of difficulty during the training for recovering the function of each of the joints as well.

While the second embodiment of the present disclosure has been described above, the aforementioned embodiment has the following features.

That is, as shown in FIGS. 13 to 18, the left leg unit 55 includes the upper front oblique piece 61 (first slider), the horizontal piece 62 (second slider), the upper rear oblique piece 63 (third slider), the upper front guide groove 70 (first guide) that guides the upper front oblique piece 61 in such a way that the upper front oblique piece 61 can be slid linearly, the horizontal guide groove 71 (second guide) that guides the horizontal piece 62 in such a way that the horizontal piece 62 can be slid linearly; the upper rear guide groove 72 (third guide) that guides the upper rear oblique piece 63 in such a way that the upper rear oblique piece 63 can be slid linearly; the outer coupling bar 64 (first coupling part) to which the upper front oblique piece 61, the horizontal piece 62, and the upper rear oblique piece 63 are rotatably coupled, thereby coupling the upper front oblique piece 61, the horizontal piece 62, and the upper rear oblique piece 63 to one another, and the pedal 65 rotatably coupled to the outer coupling bar 64. The upper front guide groove 70, the horizontal guide groove 71, and the upper rear guide groove 72 are extended in such a way that they intersect with one another at one point. As shown in FIGS. 18 to 20, the rotation axis 65*a* of the pedal 65 is disposed away from the rotation axis 61*a* of the upper front oblique piece 61, the rotation axis 62*a* of the horizontal piece 62, and the rotation axis 63*a* of the upper rear oblique piece 63 and is disposed away from the center of gravity g of the equilateral triangle N that connects the rotation axis 61*a* of the upper front oblique piece 61, the rotation axis 62*a* of the horizontal piece 62, and the rotation axis 63*a* of the upper rear oblique piece 63, whereby the rotation axis 65*a* of the pedal 65 moves along the elliptical trajectory T. According to the aforementioned configuration, the rotation axis 65*a* of the pedal 65 can be moved along the elliptical trajectory T in a simple and compact manner.

Further, the left leg unit 55 further includes the upper front coil spring 66, the horizontal coil spring 67, and the upper rear coil spring 68 as load means for applying a load to the movement of the upper front oblique piece 61, the horizontal piece 62, and the upper rear oblique piece 63. According to the aforementioned configuration, a user may mainly exercise muscle parts of the lower limb.

Note that one or two of the upper front coil spring 66, the horizontal coil spring 67, and the upper rear coil spring 68 may be omitted.

Further, as shown in FIGS. 19 and 20, the aforementioned load means applies a load to the movement of the upper front oblique piece 61, the horizontal piece 62, and the upper rear oblique piece 63 when the pedal 65 is moved in the predetermined direction D and the rotation axis 65*a* of the pedal 65 is positioned below the major axis TL of the elliptical trajectory T. On the other hand, when the pedal 65 is moved in the predetermined direction D and the rotation axis 65*a* of the pedal 65 is positioned above the major axis TL of the elliptical trajectory T, the load means does not apply a load to the movement of the upper front oblique piece 61, the horizontal piece 62, and the upper rear oblique piece 63. According to the aforementioned configuration, load conditions specific to walking, that is, a load is not applied when the user swings his/her leg forward in the swing phase and a load is applied when the user kicks his/her leg backward in the stance phase, may be obtained.

Further, as shown in FIGS. 19 and 20, the aforementioned load means applies a load to the movement of the upper front oblique piece 61, the horizontal piece 62, and the upper rear oblique piece 63 in the direction away from the intersection G. According to the aforementioned configuration, the load means may be configured in a simple manner.

Further, as shown in FIGS. 19 and 20, the aforementioned load means is a spring that is provided in the upper front guide groove 70, the horizontal guide groove 71, and the upper rear guide groove 72 and biases the upper front oblique piece 61, the horizontal piece 62, and the upper rear oblique piece 63 toward the intersection G. According to the aforementioned configuration, the load means may be configured in a simple manner.

Further, as shown in FIG. 18, the place on the outer coupling bar 64 where the pedal 65 is attached can be changed. According to the aforementioned configuration, as shown in FIG. 22, it is possible to increase or decrease the major axis and the minor axis of the elliptical trajectory T. Therefore, it is possible to adjust the major axis and the minor axis of the elliptical trajectory T, and even the stride length of the user U during the foot-pedaling exercise in accordance with the physique of the user U, and by increasing or decreasing the major axis and the minor axis of the elliptical trajectory T, the muscle part that is used for the exercise may be changed and the efficiency of the exercise may be improved. Further, by increasing or decreasing the major axis and the minor axis of the elliptical trajectory T, the range in which joint angles of mainly the hip joint, the knee joint, and the ankle joint are increased or decreased during the exercise is expanded or contracted as well, whereby it is possible to adjust the level of difficulty during the training for recovering the function of each of the joints.

Further, as shown in FIG. 13, the foot-pedaling exercise equipment 52 (pedal support system) includes the left leg unit 55 (pedal support structure for the left leg) and the right leg unit 56 (pedal support structure for the right leg). The left leg unit 55 and the right leg unit 56 are disposed so as to be opposed to each other in the width direction. According to the aforementioned configuration, the right and left legs can be trained simultaneously.

Further, as shown in FIGS. 15 to 17, the foot-pedaling exercise equipment 52 further includes the linking unit 58 (linking mechanism). As shown in FIG. 18, when the linking unit 58 is seen along the rotation axis 65*a* of the pedal 65 of the left leg unit 55, the linking unit 58 links the pedal 65 of the left leg unit 55 to the pedal 65 of the right leg unit 56 in such a way that the rotation axis 65*a* of the pedal 65 of the left leg unit 55 and the rotation axis 65*a* of the pedal 65 of the right leg unit 56 are become point symmetrical to each other with respect to the intersection G. According to the aforementioned configuration, it is possible to simulate the movement of the right and left legs during walking more strictly.

Further, as shown in FIGS. 15 to 17, the linking unit 58 includes the base shaft 81 that is rotatably supported, the left-leg-side crank arm 82 and the right-leg-side crank arm 83 extended from the base shaft 81, the left-leg-side crank arm 82 being extended from the base shaft 81 in a direction opposite to that in which the right-leg-side crank arm 83 is extended; the left-leg-side inner coupling part 84 (left-leg-side second coupling part) to which the upper front oblique piece 61, the horizontal piece 62, and the upper rear oblique piece 63 of the left leg unit 55 are rotatably coupled, thereby coupling the upper front oblique piece 61, the horizontal piece 62, and the upper rear oblique piece 63 of the left leg unit 55 to one another; and the right-leg-side inner coupling part 85 (right-leg-side second coupling part) to which the upper front oblique piece 61, the horizontal piece 62, and the upper rear oblique piece 63 of the right leg unit 56 are rotatably coupled, thereby coupling the upper front oblique piece 61, the horizontal piece 62, and the upper rear oblique piece 63 of the right leg unit 56 to one another. The left-leg-side crank arm 82 is rotatably coupled to the left-leg-side inner coupling part 84 at the center of gravity g of the equilateral triangle N of the left leg unit 55 in the left-leg-side inner coupling part 84 in a side view. The right-leg-side crank arm 83 is rotatably coupled to the right-leg-side inner coupling part 85 at the center of gravity g of the equilateral triangle N in the right-leg-side inner coupling part 85 of the right leg unit 56 in a side view. According to the aforementioned configuration, the linking unit 58 may be obtained.

Modified Example

Next, a modified example of the linking unit 58 will be described.

FIG. 23 shows a plan view of a linking unit 58 according to the modified example. In this modified example, the linking unit 58 includes a left-leg-side horizontal rack 90 fixed to a horizontal piece 62 of a left leg unit 55, a right-leg-side horizontal rack 91 fixed to the horizontal piece 62 of a right leg unit 56, and a pinion 92 that meshes with the left-leg-side horizontal rack 90 and the right-leg-side horizontal rack 91 simultaneously. The left-leg-side horizontal rack 90 and the right-leg-side horizontal rack 91 are specific examples of a left-leg-side rack and a right-leg-side rack, respectively.

The left-leg-side horizontal rack 90 is fixed to the horizontal piece 62 of the left leg unit 55 and is extended in the front-back direction. The right-leg-side horizontal rack 91 is fixed to the horizontal piece 62 of the right leg unit 56 and is extended in the front-back direction. In general, the pinion 92 is rotatably (it can freely conduct a yaw turn) supported by the support pillar 86 shown in FIG. 16. In this configuration, when the horizontal piece 62 of the left leg unit 55 moves forward, the horizontal piece 62 of the right leg unit 56 moves backward. On the other hand, when the horizontal piece 62 of the left leg unit 55 moves backward, the horizontal piece 62 of the right leg unit 56 moves forward. In this manner, the horizontal piece 62 of the left leg unit 55 and the horizontal piece 62 of the right leg unit 56 move forward and backward in an alternate manner. With this configuration as well, as shown in FIG. 18, the pedal 65 of the left leg unit 55 and the pedal 65 of the right leg unit 56 may be linked to each other in such a way that the rotation axis 65*a* of the pedal 65 of the left leg unit 55 and the rotation axis 65*a* of the pedal 65 of the right leg unit 56 become point symmetrical to each other with respect to the intersection G.

To sum up, the linking unit 58 includes the left-leg-side horizontal rack 90 (left-leg-side rack) fixed to the horizontal piece 62 of the left leg unit 55, the right-leg-side horizontal rack 91 (right-leg-side rack) fixed to the horizontal piece 62 of the right leg unit 56, and the pinion 92 that meshes with the left-leg-side horizontal rack 90 and the right-leg-side horizontal rack 91. According to the aforementioned configuration, the linking unit 58 may be obtained with a simple configuration.

In place of the aforementioned configuration, the linking unit 58 may include a rack that is fixed to the upper front oblique piece 61 of the left leg unit 55 and is extended along the longitudinal direction of the upper front guide groove 70, a rack that is fixed to the upper front oblique piece 61 of the right leg unit 56 and is extended along the longitudinal direction of the upper front guide groove 70, and a pinion that meshes with the two racks simultaneously. With this alternative configuration as well, the linking unit 58 may be obtained with a simple configuration. The linking unit 58 of a rack pinion type may also be applied to the upper rear oblique piece 63.

The aforementioned second embodiment may be changed, for example, as follows.

That is, as shown in FIG. 18, while each of the angle between the upper front guide groove 70 and the horizontal guide groove 71, the angle between the horizontal guide groove 71 and the upper rear guide groove 72, and the angle between the upper rear guide groove 72 and the upper front guide groove 70 is 60 degrees in the aforementioned second embodiment, these angles may be different from one another.

Likewise, while the horizontal guide groove 71 is extended along the front-back direction in a side view in the aforementioned second embodiment, the horizontal guide groove 71 may be inclined with respect to the front-back direction.

Further, in the aforementioned second embodiment, the rotation axis 65*a* of the pedal 65 is disposed on an extension of the line 79 that connects the rotation axis 62*a* of the horizontal piece 62 to the center of gravity g. Alternatively, the rotation axis 65*a* of the pedal 65 may be disposed in a desired position which is neither on the line 79 that connects the rotation axis 62*a* of the horizontal piece 62 to the center of gravity g nor on an extension of this line 79. In this case, the major axis TL of the elliptical trajectory T shown in FIGS. 19 and 20 will be inclined with respect to the front-back direction.

Further, as shown in FIG. 18, in the aforementioned second embodiment, the rotation axis 65*a* of the pedal 65 is disposed on an extension of the line 79 that connects the rotation axis 62*a* of the horizontal piece 62 to the center of gravity g. Alternatively, the rotation axis 65*a* of the pedal 65 may be disposed on the equilateral triangle N.

As described above, it may be decided as desired regarding how to dispose the rotation axis 65*a* of the pedal 65 in the rotation axis 61*a* of the upper front oblique piece 61, the rotation axis 62*a* of the horizontal piece 62, and the rotation axis 63*a* of the upper rear oblique piece 63. It should be noted, however, as an exception, when the rotation axis 65*a* of the pedal 65 is made to match one of the rotation axis 61*a* of the upper front oblique piece 61, the rotation axis 62*a* of the horizontal piece 62, and the rotation axis 63*a* of the upper rear oblique piece 63, the rotation axis 65*a* of the pedal 65 linearly moves in a side view, and therefore the pedal 65 cannot be moved along the elliptical trajectory.

Likewise, it should be noted that, as an exception, when the rotation axis 65*a* of the pedal 65 is disposed at the center of gravity g of the equilateral triangle N, the rotation axis 65*a* of the pedal 65 circularly moves along a circular trajectory in a side view, and therefore the pedal 65 cannot be moved along the elliptical trajectory.

Figure 24:
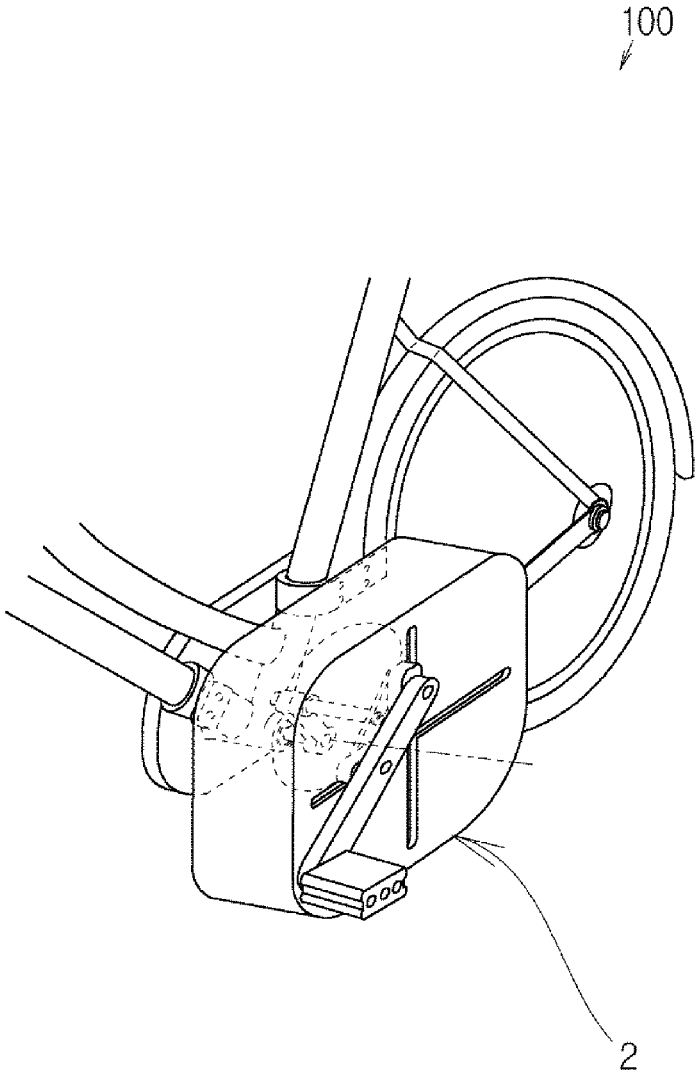
FIG. 24 is a diagram showing an example to which a foot-pedaling exercise equipment is applied (modified example).

The foot-pedaling exercise equipment 2 shown in FIG. 2 and the foot-pedaling exercise equipment 52 shown in FIG. 13 can be applied to a bicycle, Aerobike (registered trademark), a recumbent bike, a foot-pedaling wheelchair, or a rotary generator. FIG. 24 illustrates a case in which the foot-pedaling exercise equipment 2 according to the first embodiment is applied to a bicycle 100. By applying the foot-pedaling exercise equipment 2 according to the first embodiment to the bicycle 100, it is possible to repeatedly generate elliptical trajectories of feet and the load conditions simultaneously when the user performs aerobic exercise using the bicycle 100.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A pedal support structure comprising:

a first slider;

a second slider;

a first guide that guides the first slider in such a way that the first slider is configured to be slid linearly;

a second guide that guides the second slider in such a way that the second slider is configured to be slid linearly;

a first coupling part to which the first slider and the second slider are rotatably coupled, thereby coupling the first slider and the second slider to each other;

a pedal rotatably coupled to the first coupling part; and load means for applying a load to a movement of the first slider or the second slider, wherein the first guide and the second guide are extended in such a way that they intersect with each other, a rotation axis of the pedal is disposed away from a rotation axis of the first slider and a rotation axis of the second slider and is disposed away from a midpoint of a line that connects the rotation axis of the first slider and the rotation axis of the second slider, whereby the rotation axis of the pedal moves along an elliptical trajectory, and the load means applies a load to the movement of the first slider or the second slider when the pedal is moved in a predetermined direction and the rotation axis of the pedal is located below the major axis of the elliptical trajectory, and does not apply a load to the movement of the first slider or the second slider when the pedal is moved in a predetermined direction and the rotation axis of the pedal is positioned above the major axis of the elliptical trajectory.

2. The pedal support structure according to claim 1, wherein the place on the first coupling part where the pedal is attached is capable of being changed.

3. A pedal support system comprising:

a pedal support structure for a left leg as the pedal support structure according to claim 1; and a pedal support structure for a right leg as the pedal support structure according to claim 1, wherein the pedal support structure for the left leg and the pedal support structure for the right leg are disposed so as to be opposed to each other.

4. The pedal support system according to claim 3, further comprising a linking mechanism that links the pedal of the pedal support structure for the left leg to the pedal of the pedal support structure for the right leg in such a way that the rotation axis of the pedal of the pedal support structure for the left leg and the rotation axis of the pedal of the pedal support structure for the right leg become point symmetrical with respect to the intersection of the first guide and the second guide of the pedal support structure for the left leg when the pedal support system is seen along the rotation axis of the pedal of the pedal support structure for the left leg.

5. The pedal support system according to claim 4, wherein the linking mechanism comprises:

a left-leg-side rack fixed to the second slider of the pedal support structure for the left leg;

a right-leg-side rack fixed to the second slider of the pedal support structure for the right leg; and a pinion that meshes with the left-leg-side rack and the right-leg-side rack.

6. The pedal support system according to claim 4, wherein the linking mechanism comprises:

a base shaft rotatably supported;

a left-leg-side crank arm and a right-leg-side crank arm extended from the base shaft, the left-leg-side crank arm being extended from the base shaft in a direction opposite to that in which the right-leg-side crank arm is extended;

a left-leg-side second coupling part to which the first slider and the second slider of the pedal support structure for the left leg are rotatably coupled, thereby coupling the first slider and the second slider of the pedal support structure for the left leg to each other; and a right-leg-side second coupling part to which the first slider and the second slider of the pedal support structure for the right leg are rotatably coupled, thereby coupling the first slider and the second slider of the pedal support structure for the right leg to each other, wherein the left-leg-side crank arm is rotatably coupled to the left-leg-side second coupling part at the midpoint of the pedal support structure for the left leg, and the right-leg-side crank arm is rotatably coupled to the right-leg-side second coupling part at the midpoint of the pedal support structure for the right leg.

7. A pedal support structure comprising:

a first slider;

a second slider;

a first guide that guides the first slider in such a way that the first slider is configured to be slid linearly;

a second guide that guides the second slider in such a way that the second slider is configured to be slid linearly;

a first coupling part to which the first slider and the second slider are rotatably coupled, thereby coupling the first slider and the second slider to each other, a pedal rotatably coupled to the first coupling part; and load means for applying a load to a movement of the first slider or the second slider, wherein, the first guide and the second guide are extended in such a way that they intersect with each other, a rotation axis of the pedal is disposed away from a rotation axis of the first slider and a rotation axis of the second slider and is disposed away from a midpoint of a line that connects the rotation axis of the first slider and the rotation axis of the second slider, whereby the rotation axis of the pedal moves along an elliptical trajectory, the load means applies a load to a movement of the first slider or the second slider in a direction that is away from the intersection of the first guide and the second guide, and the load means is a spring that is provided in the first guide or the second guide and biases the first slider or the second slider toward the intersection.

* * * * *